US009016537B2

(12) United States Patent
Shishido et al.

(10) Patent No.: US 9,016,537 B2
(45) Date of Patent: Apr. 28, 2015

(54) TRACTOR AND PRINTER USING THE SAME

(75) Inventors: Norifumi Shishido, Shizuoka-ken (JP); Satoshi Kitahara, Shizuoka-ken (JP)

(73) Assignee: Toshiba Tec Kabushiki Kaisha, Tokyo (JP)

( * ) Notice: Subject to any disclaimer, the term of this patent is extended or adjusted under 35 U.S.C. 154(b) by 332 days.

(21) Appl. No.: 13/494,149

(22) Filed: Jun. 12, 2012

(65) Prior Publication Data

US 2012/0318839 A1 Dec. 20, 2012

(30) Foreign Application Priority Data

Jun. 20, 2011 (JP) ..... 2011-136515
Oct. 28, 2011 (JP) ..... 2011-237560

(51) Int. Cl.
*B65H 20/20* (2006.01)
*B41J 11/30* (2006.01)
*B41J 11/32* (2006.01)

(52) U.S. Cl.
CPC *B41J 11/30* (2013.01); *B41J 11/32* (2013.01); *B65H 20/20* (2013.01)

(58) Field of Classification Search
USPC ..... 226/74, 75, 79, 81
See application file for complete search history.

(56) References Cited

FOREIGN PATENT DOCUMENTS

| | | |
|---|---|---|
| JP | 06-056320 | 3/1994 |
| JP | 09-188445 | 7/1997 |
| JP | 10-279144 | 10/1998 |
| JP | 2003-285482 | 10/2003 |

OTHER PUBLICATIONS

Machine Translation of JP 09-188445 A, Jul. 22, 1997.*
English Translation of Office Action of Notice of Rejection for Japanese Patent Application No. 2011-237560 Dated Apr. 16, 2013, 6 pgs.

* cited by examiner

*Primary Examiner* — William E Dondero
(74) *Attorney, Agent, or Firm* — Amin, Turocy & Watson, LLP

(57) ABSTRACT

According to one embodiment, a tractor comprises a guide shaft, a first belt unit, a second belt unit, a fixing unit and a connecting unit. The first belt unit is supported by the guide shaft so as to move in an axis direction of the guide shaft. The second belt unit is arranged to face the first belt unit in the axis direction of the guide shaft and supported by the guide shaft. The fixing unit, which is movably supported by the guide shaft in the axis direction of the guide shaft and is capable of being fixed on the guide shaft. The connecting unit configured to connect the first belt unit to the fixing unit with a clearance in the axis direction of the guide shaft.

7 Claims, 24 Drawing Sheets

(A)

(B)

(A)

(B)

TRACTOR AND PRINTER USING THE SAME

CROSS-REFERENCE TO RELATED APPLICATIONS

The present application is based upon and claims the benefit of priorities from Japanese Patent Application No. 2011-136515 filed on Jun. 20, 2011 and Japanese Patent Application No. 2011-237560 filed on Oct. 28, 2011 the entire contents of which are hereby incorporated by reference.

FIELD

Embodiments described herein relate to a tractor for feeding a tractor paper and a printer which is equipped with the tractor.

BACKGROUND

There has been developed a tractor, which is mounted on a printer to feed tractor paper.

Feeding holes are respectively formed on opposite sides in width of a tractor paper along a paper feeding direction (conveying direction). On the other hand, the tractor has a pair of belt units provided with pin belts, wherein a plurality of pins is arranged on each pin belt. The pin belts rotate in a state that the pins of the pin belts are inserted into the feeding holes on the tractor paper so as to convey the tractor paper.

In order to deal with tractor papers having different widths, the pair of belt units arranged in such a tractor is supported by a guide shaft in a movable manner so that the space between the pair of belt units may be adjusted. In such a tractor, belt units are fixed at adjusted positions after the adjustment.

DETAILED DESCRIPTION

According to one embodiment, a tractor comprises a tractor comprises a guide shaft, a first belt unit, a second belt unit, a fixing unit and a connecting unit. The first belt unit is supported by the guide shaft so as to move in an axis direction of the guide shaft, which includes a rotatable endless pin belt which is provided with a plurality of pins inserting into one of a pair of feeding hole lines formed on a tractor paper. The second belt unit is arranged to face the first belt unit in the axis direction of the guide shaft and supported by the guide shaft, which includes a rotatable endless pin belt which is provided with a plurality of pins inserting into the other feeding hole line formed on a tractor paper. The fixing unit, which is movably supported by the guide shaft in the axis direction of the guide shaft and is capable of being fixed on the guide shaft. The connecting unit configured to connect the first belt unit to the fixing unit with a clearance in the axis direction of the guide shaft.

Hereinafter, embodiments are described in detail with reference to the accompanying drawings. For the sake of a convenient description, the width direction of the main body 2 of a business machine 1 is set to be a direction X, the depth direction of the main body 2 of the business machine 1 to be a direction Y, and the height direction of the main body 2 of the business machine 1 to be a direction Z. The directions X, Y and Z are orthogonal to each other. Moreover, in the following description, the near side and the far side in the direction Y from a view of an operator (user) of the main body 2 are respectively set to be the front side and the back side of the main body 2.

First Embodiment

Figure 1:
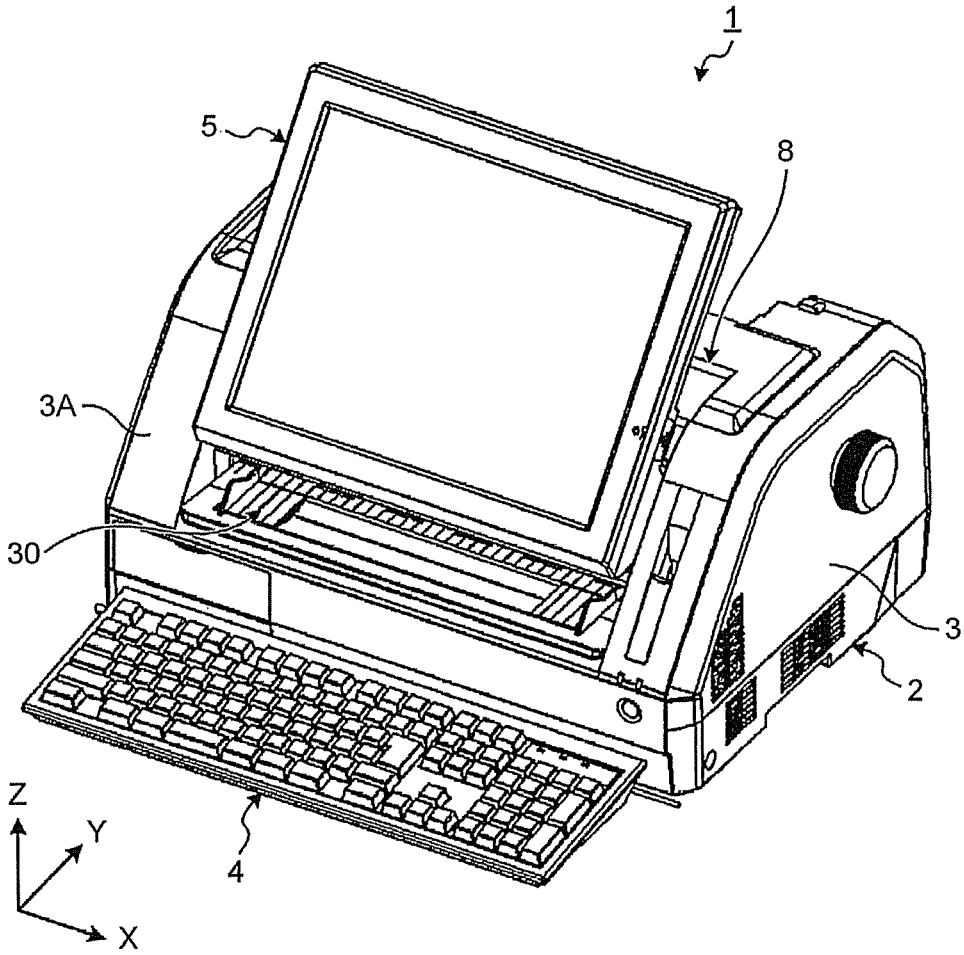
FIG. 1 is a perspective view of a business machine at a front side thereof according to a first embodiment.

As shown in FIG. 1, a business machine 1 according to this embodiment comprises a main body 2, a keyboard 4 and a display 5. The keyboard 4 and the display 5 are arranged at the front side 3A of the frame 3 of the main body 2 so that a user (operator) operates the business machine 1 in front of the main body 2.

Figure 2:
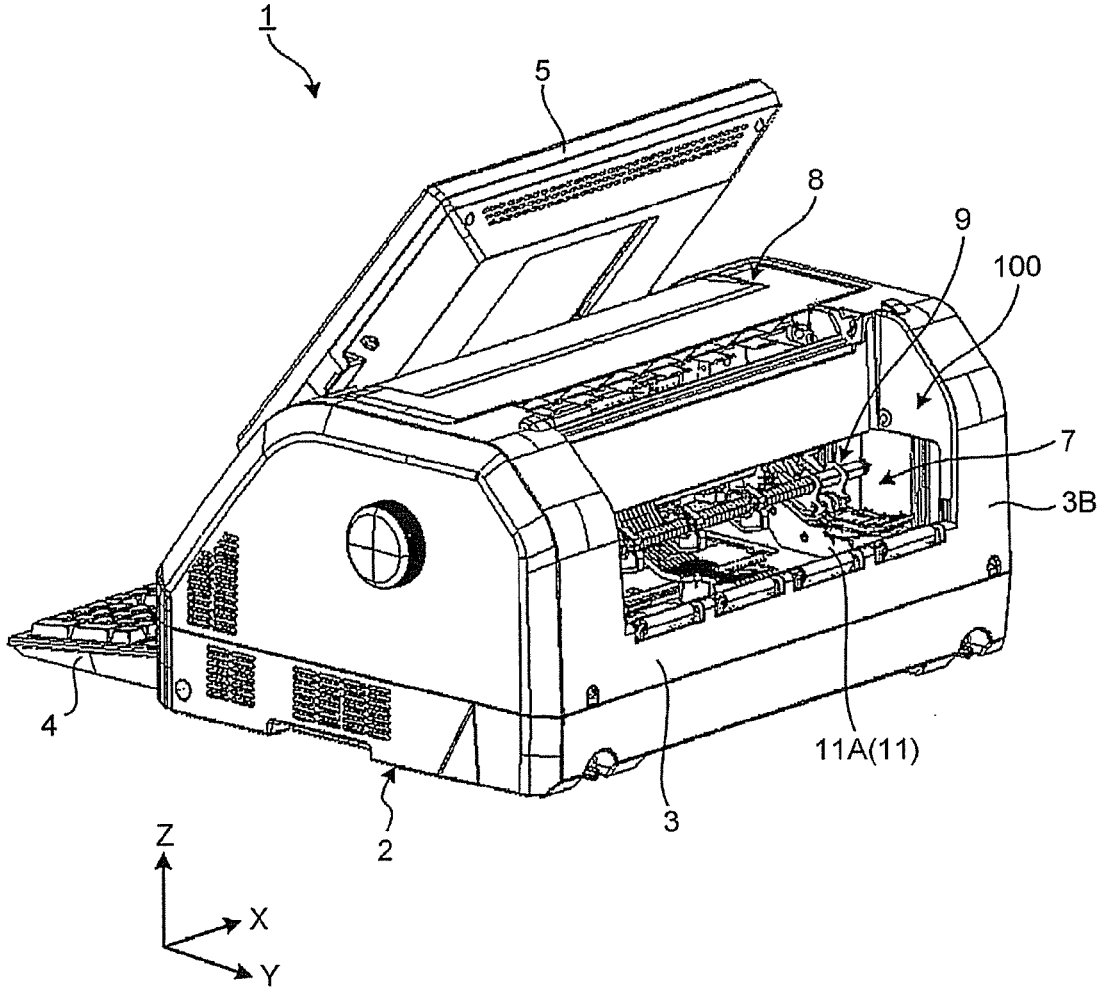
FIG. 2 is a perspective view of the business machine at a back side shown in FIG. 1.

A printer unit (not shown) and a control unit (not shown) are accommodated in the frame 3 of the main body 2. As shown in FIG. 2, a paper inlet 7 for feeding a tractor paper 6 (refer to FIG. 3) is formed at a position of the frame 3 opposite to the display 5 (the back side 3B of the frame 3). A tractor 9 for conveying the tractor paper 6 is accommodated in the frame 3. A paper outlet 8 is arranged on the upper part of the frame 3 to discharge the tractor paper 6 that is printed after it is taken into the frame 3 from the paper inlet 7. Moreover, as shown in FIG. 1, another paper inlet 30 is also arranged below the display 5. A conveying mechanism (not shown) different from the tractor 9 conveys, using a roller and the like, the paper inserted by an operator from the paper inlet 30 below the display 5 and discharges the paper printed by the printer unit from the paper outlet 8. In this embodiment, the tractor 9, the printer unit and the conveying mechanism together constitute a printer 100. The printer unit is provided with a print head such as an impact dot printing head, thermal printing head or inkjet printing head.

Figure 3:
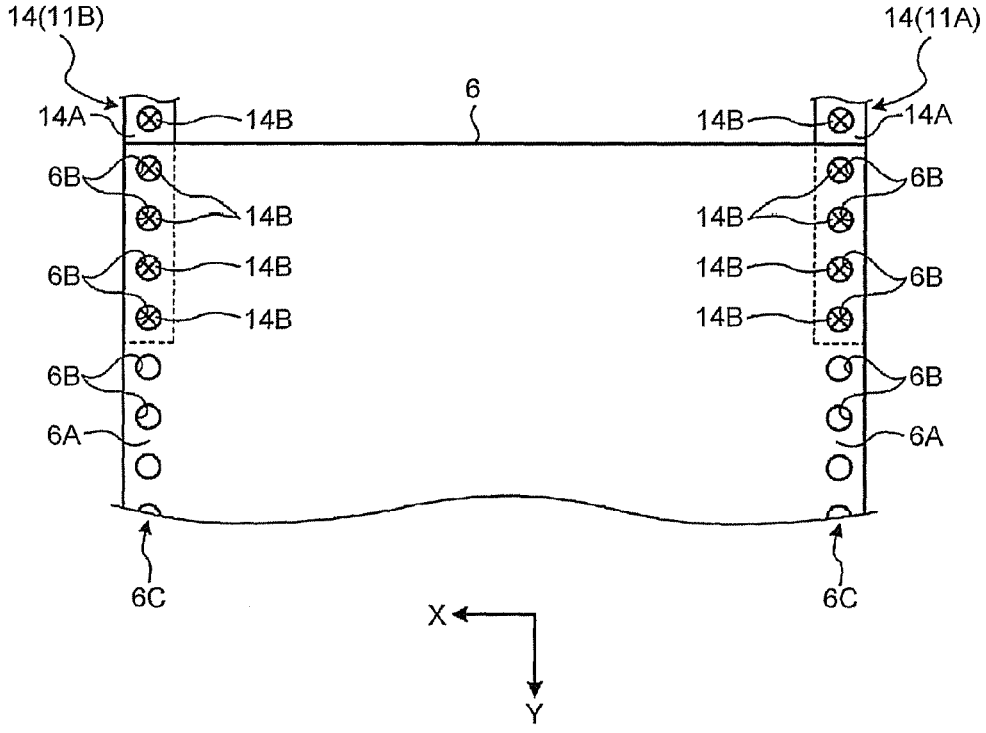
FIG. 3 is a plane view of a tractor paper loaded on a tractor according to the first embodiment.

The tractor paper shown in FIG. 3 is a long length belt shaped paper. Regularly-spaced feeding holes GB are respectively formed along the length direction on the opposite sides 6A of the tractor paper 6 orthogonal to the length direction (paper conveying direction). That is, a pair of feeding holes rows 6C composed of a plurality of feeding holes 6B are formed on the tractor paper. Moreover, perforations (not shown) are formed in a width direction of the paper 6 and are provided in the length direction thereof at regular intervals to cut the paper along the perforation line. The tractor paper 6 that is folded in zigzag manner at perforation lines as a crease is placed behind the business machine 1. The opposite sides 6A of the tractor paper 6 are supported by the tractor 9, respectively. The tractor 9 draws out the tractor paper 6 from the top of the folded tractor paper and then conveys the tractor paper to the inside of the main body 2. A slip such as an invoice paper laminated with a plurality of papers is referred to as an example of the tractor paper 6.

Figure 4:
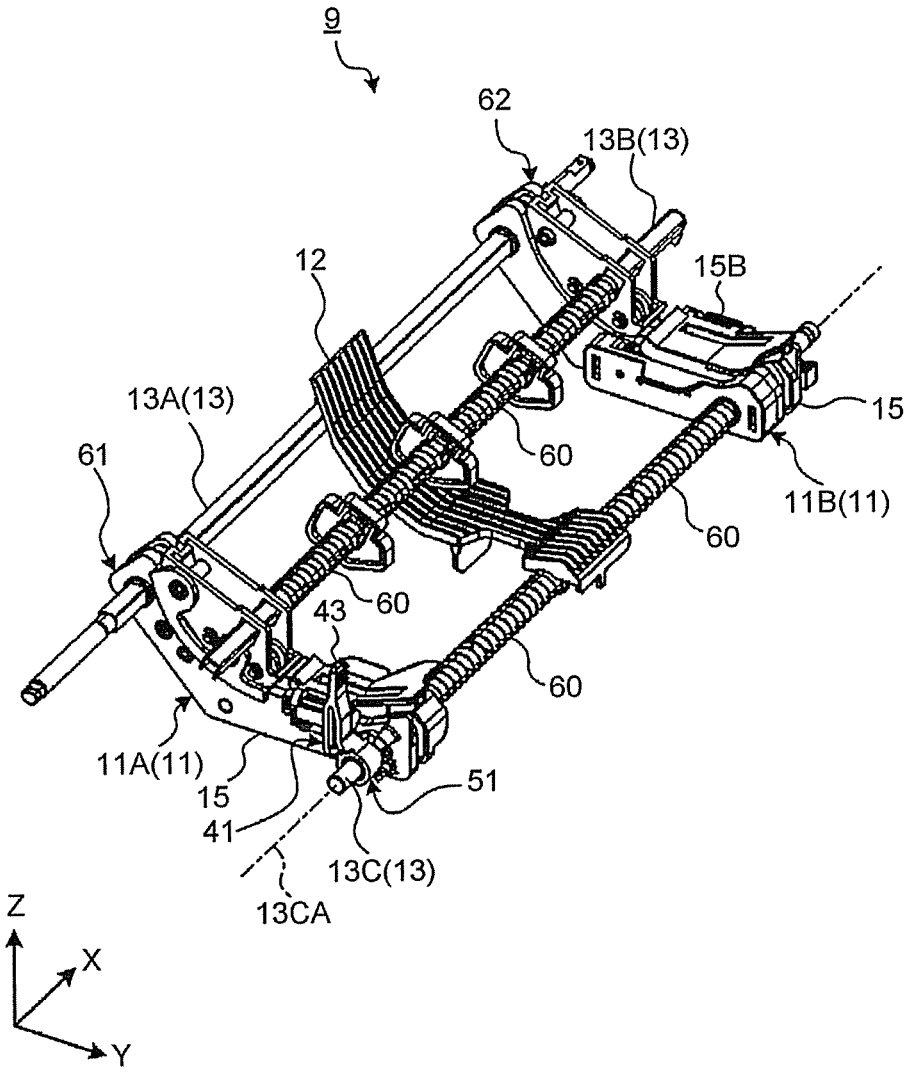
FIG. 4 is a perspective view of the tractor according to the first embodiment.

As shown in FIG. 4, the tractor 9 comprises a pair of belt units 11, a guide unit 12 and a plurality of guide shafts 13.

In this embodiment, the plurality of guide shafts 13 consist of a first guide shaft 13A, a second guide shaft 13B and a third guide shaft 13C. In the following description, the first guide shaft 13A, the second guide shaft 13B and the third guide shaft 13C are simply referred to as a guide shaft 13 in some cases. The plurality of guide shafts 13 are arranged in a mutually parallel manner. The axis 13CA of the guide shaft 13 is parallel to the width direction of the main body 2. Each guide shaft 13 is arranged between the side walls of the frame 3. The guide shafts 13 support the pair of belt units 11 and move the belt units 11 in the axis direction 13CA thereof. A guide unit 12 is held at the axial center of the guide shaft 13 by a supporting device (not shown). Therefore, the third guide shaft 13C may rotate around the axis 13CA thereof. Moreover, the first and the second guide shafts 13A and 13B function as a first restriction section to limit the rotation of the pair of belt units 11 around the axis 13CA of the third guide shaft 13C. The axis 13CA of the third guide shaft 13C is represented with a dotted line in FIG. 4.

In this embodiment, the pair of belt units 11 consists of a first belt unit 11A and a second belt unit 11B. In the following description, the first and the second belt units 11A and 11B are simply referred to as a belt unit 11 in some cases. The first and the second belt units 11A and 11B are substantially symmetrical to each other in the horizontal direction. The operator may change the space between the belt units 11 by sliding either of the belt units 11 along the guide shaft 13. Thus, the operator may align the belt units 11 with the opposite sides 6A of the tractor paper 6 according to the width of the tractor paper 6 to install the feeding holes 6*b* of the tractor paper 6 on the pin belts 14 of the belt units 11 at the opposite sides respectively.

The guide unit 12 is arranged in the middle of the pair of belt units 11. The guide unit 12 is movably supported by the first guide shaft 13A and the third guide shaft 13C along the axis direction 13CA of the guide shaft 13. The guide unit 12 is connected with the pair of belt units 11 by a plurality of coil springs 60 and is always located at the substantially middle position of the belt units 11 with the elastic force of the coil springs. The coil springs 60 are arranged on the first guide shaft 13A and the third guide shaft 13C. The guide unit 12 supports, from the below, the substantially central part of the tractor paper 6 held on the belt units 11, thereby preventing the tractor paper 6 from being curved due to the force of gravity so that no tension is applied to the opposite sides 6A of the tractor paper 6.

The belt units 11 and the guide unit 12 are curved into a bow shape, and the tractor paper 6 is conveyed from the paper inlet 7 to the paper outlet 8 (refer to FIG. 2) along the curve.

Figure 5:
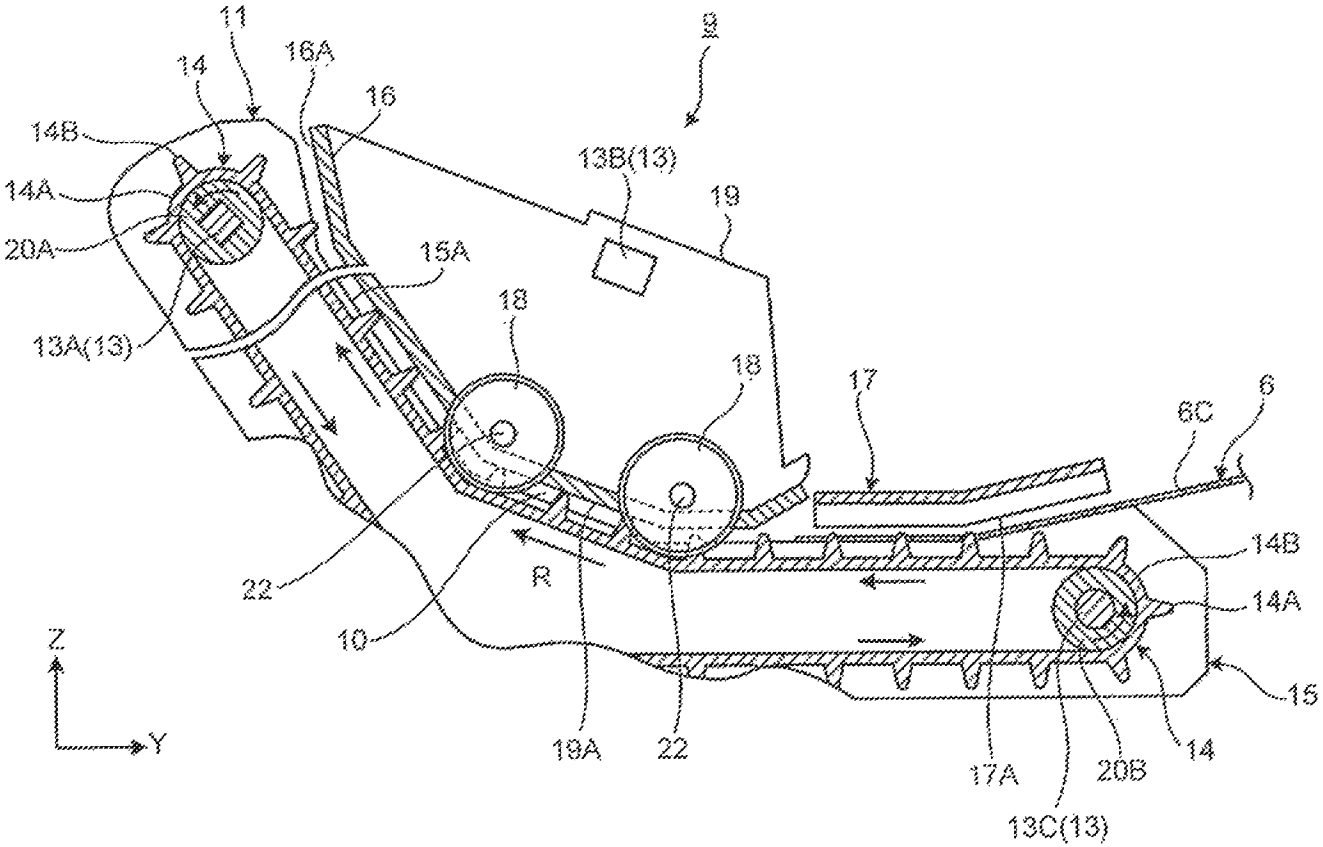
FIG. 5 is a side sectional view of the tractor according to the first embodiment.

The belt unit 11 is described below in detail. As shown in FIG. 5, the belt unit 11 comprises a pin belt 14, a base 15, a fixed cover 16, a movable cover 17 and a roller keeper 19*f* through which the second guide shaft 13B runs. In FIG. 5, a part of the belt unit 11 is cut away and is therefore not shown.

The movable cover 17 is rotationally supported on the base 15 of the belt unit 11 via a hinge unit 15B (refer to FIG. 4). Under the force applied by the operator manually, the movable cover 17 reciprocates between the vertical opening position (not shown) and the horizontal closing position (refer to FIG. 4). The hinge unit 15B is provided on each belt unit 11 at a position outside the tractor paper 6 in the width direction. Moreover, the rotation shaft of the hinge unit 15B is configured along the opposite ends of the tractor paper 6 in the width direction, that is, the opposite sides of the tractor paper 6. Therefore, the two movable covers 17 arranged on the belt units 11 are opened like a double door from the horizontal closing position that the two movable covers 17 face each other toward inside in the width direction to the vertical opening position that the two movable covers 17 vertically position at the outside of the tractor paper 6. The movable cover 17 is manually opened by the operator to fit the feeding holes 6B of the tractor paper 6 to the pins 14B of the pin belt 14, thereby setting the tractor paper 6 on the pin belt 14.

As shown in FIG. 5, the base 15 supports the fixed cover 16, the movable cover 17 and the roller keeper 19. The base 15 rotationally supports a plurality of rollers 20A and 20B. Further, an endless pin belt 14 is rotationally arranged around the roller 20A and the roller 20B. The roller 20A is rotationally driven by a motor (not shown) through the first guide shaft 13A. The roller 20A is rotationally driven to drive the pin belt 14 in a rotary movement in a direction indicated by the arrow in FIG. 5.

As shown in FIG. 5, the fixed cover 16 and the movable cover 17 are arranged to cover the upper part of the base 15. The lower surface 16A of the fixed cover 16, the lower surface 17A of the movable cover 17 at the closed position and the lower surface 19A of the roller keeper 19 are substantially spaced from the upper surface 15A of the base 15 by a fixed space so as to be arranged opposite to the upper surface 15A of the base 15. A conveying path 10 for conveying the tractor paper 6 along with the rotation of the pin belt 14 is located between the lower surfaces 16A, 17A and 19A and the upper surface 15A of the base 15. The conveying path 10 in the tractor forms a part of the conveying path of the printer 10 for conveying the tractor paper 6.

That is, the tractor 9 takes thereinto the tractor paper 6 placed on the paper inlet 7 (refer to FIG. 2) and conveys the tractor paper 6 along the conveying path 10 in the tractor. Moreover, the tractor 9 conveys the tractor paper 6 printed by the printer unit (not shown) to the paper outlet 8 (refer to FIG. 2) and discharges the printed tractor paper 6 from the paper outlet 8.

The pin belt 14 is made from elastomer or other flexible materials. As shown in FIG. 5, the pin belt 14 comprises a belt unit 14A of a fixed width and a plurality of pins 14B that protrude, at given intervals along a circumferential direction, at the center part of the belt unit 14A in the peripheral width direction thereof. In the middle part of the belt unit 14 within the conveying path 10 of the tractor (that is, the part of the conveying path 10 from a position nearby the lower part of the movable cover 17 to a position nearby the lower part of the fixed cover 16), the top ends of the pins 14*b* protrude upwards from the upper surface 15A of the base 15. Therefore, the feeding holes 6B of the tractor paper 6 are clamped by the pins 14B located at the middle part of the belt unit 11 within the conveying path 10 of the tractor so that the tractor paper 6 is towed in the conveying path 10 with the rotation of the pin belt 14.

The roller keeper 19 rotationally supports a roller 18 through a support shaft 22. A groove 18A (refer to FIG. 7) into which the pins 14B are inserted is formed on the outer periphery of the roller 18.

When the tractor paper 6 is conveyed to the position of the roller 18 with the rotation of the pin belt 14, the roller 18 and the pin belt 14 rotate together to feed out the tractor paper 6 in the conveying direction of the conveying path 10 along the curved shape of the pine belt 14. Moreover, at the curved part of the pin belt 14, the pin belt 14 is conveyed in a state that the pins 14B of the pin belt 14 are firmly fitted into the groove 18A (refer to FIG. 7) of the roller 18.

As stated above, the first belt unit 11A shown in FIG. 4 comprises an endless pin belt 14 which rotates and is provided with pins 14B inserted into one of the two feeding hole rows 6C formed on the tractor paper 6. Moreover, the first belt unit 11A is movably supported by the guide shaft 13 in the axis 13CA direction of the guide shaft 13. The second belt unit 11B comprises an endless pin belt 14 which rotates and is provided with the pins inserted into the other row of the feeding holes 60 formed on the tractor paper 6. The second belt unit 11B is arranged opposite to the first belt unit 11A 3 in the axis 13CA direction of the guide shaft 13 and is movably supported by the guide shaft 13.

Figure 6:
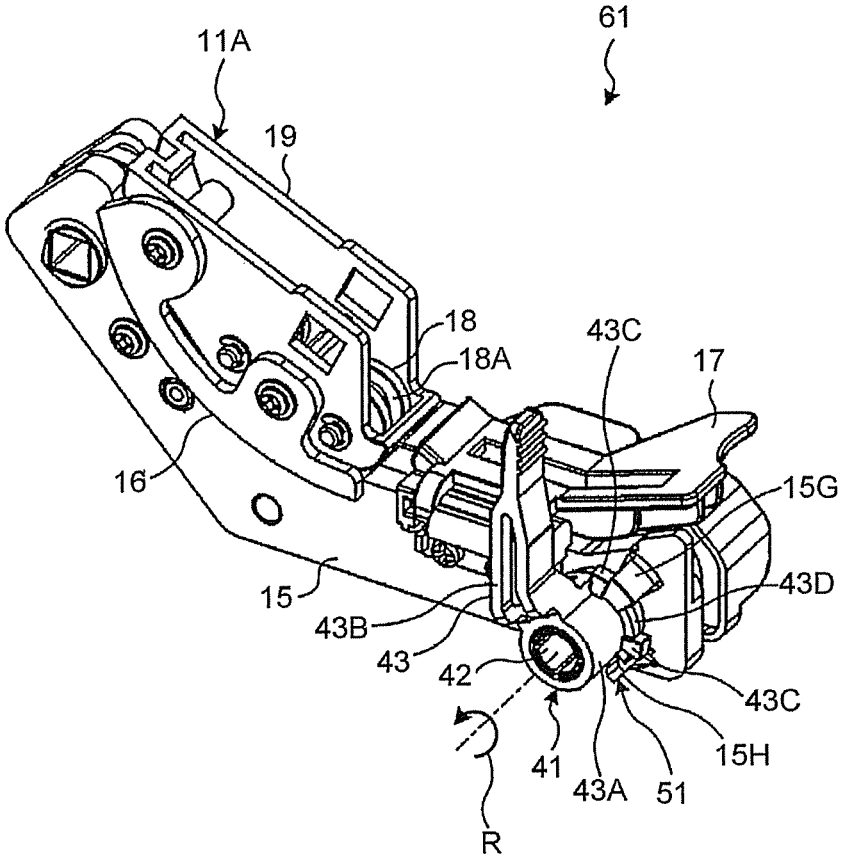
FIG. 6 is a perspective view of a first movable unit according to the first embodiment.

As shown in FIG. 6, the first belt unit 11A is connected with a first fixing unit 41 via a first connecting unit 51. The first fixing unit 41 is a lock mechanism that can be fixed on the third guide shaft 13C. The first connecting unit 51, which has a clearance in the axis 13CA direction of the third guide shaft 13C, connects the first belt unit 11A with the first fixing unit 41. The first belt unit 11A, the first fixing unit 41 and the first connecting unit 51 together constitute a first movable unit 61.

Figure 7:
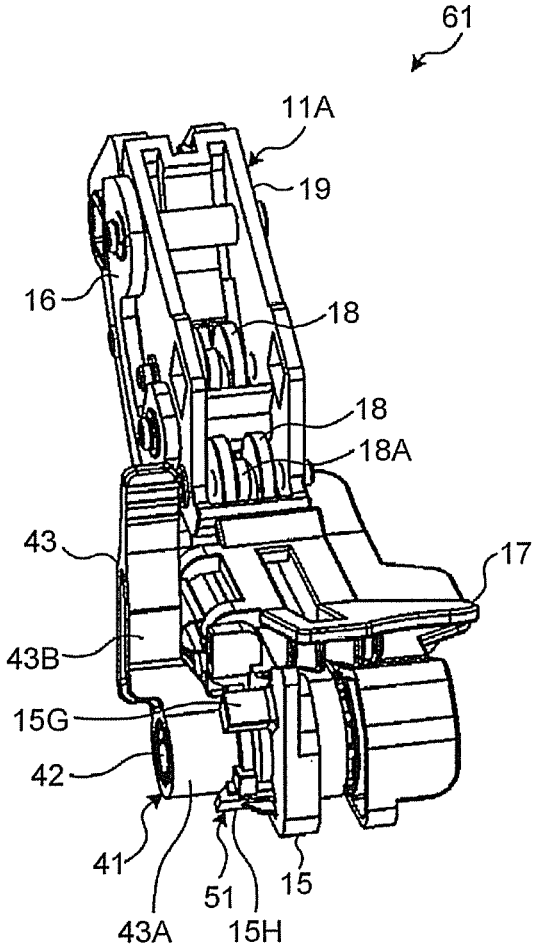
FIG. 7 is a perspective view of the first movable unit according to the first embodiment wherein an operating member is located at a release position.
Figure 8:
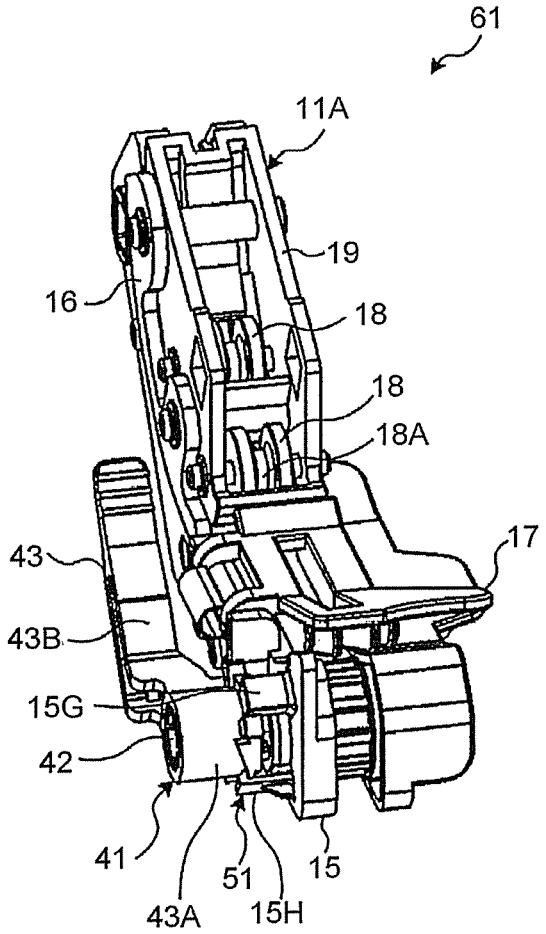
FIG. 8 is a perspective view of the first movable unit shown in FIG. 7 wherein the operating member is located at a fixed position.

Here, the first fixing unit 41 released from the fixed state on the third guide shaft 13C is shown in FIG. 7, while the first fixing unit 41 fixed on the third guide shaft 13C is shown in FIG. 8. In this embodiment, in a state that at least the first fixing unit 41 is fixed on the third guide shaft 13C, the first belt unit 11A has a clearance in the axis direction 13CA of the third guide shaft 13C so as to be connected with the first fixing unit 41 via the first connecting unit 51.

Figure 9:
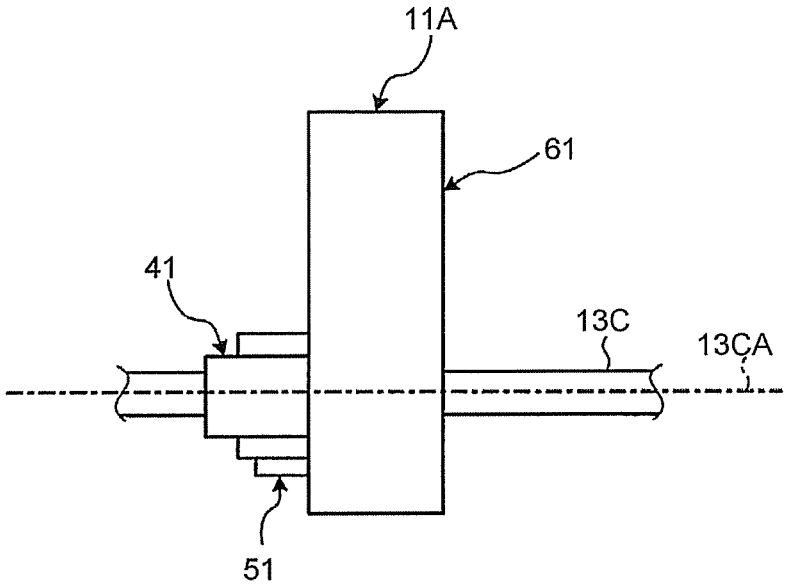
FIG. 9 is a rough plane view of the first movable unit shown in FIG. 6.
Figure 9:
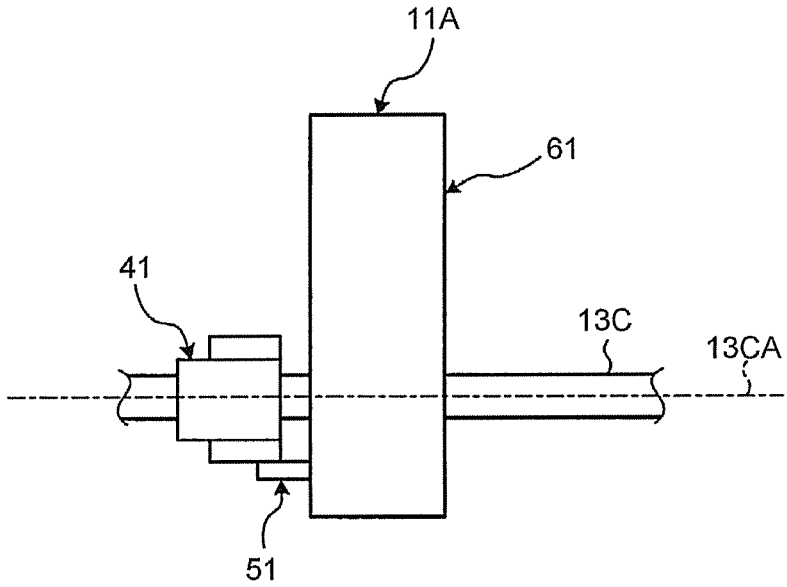

The first movable unit 61 is outlined in FIG. 9 to illustrate the clearance. As shown in FIG. 9, the first belt unit 11A is connected with the first fixing unit 41 via the first connecting unit 51 so as to be movable between a first position (FIG. 9 (A)) that the first belt unit 11A positions closest to the first fixing unit 41 and a second position (FIG. 9 (B)) that the first belt unit 11A positions furthest from the first fixing unit 41. Moreover, the first and the second positions are the relative positions of the first belt unit 11A with respect to the first fixing unit 41. The first connecting unit 51 enables the clearance in the state that the first fixing unit 41 is fixed on the third guide shaft 13C to be greater than that in the state that the first fixing unit 41 is released from the fixation on the third guide shaft 13C. The clearance of the first fixing unit 41 released from the fixing on the third guide shaft 13C may be a given clearance greater than or equal to 0.

Figure 10:
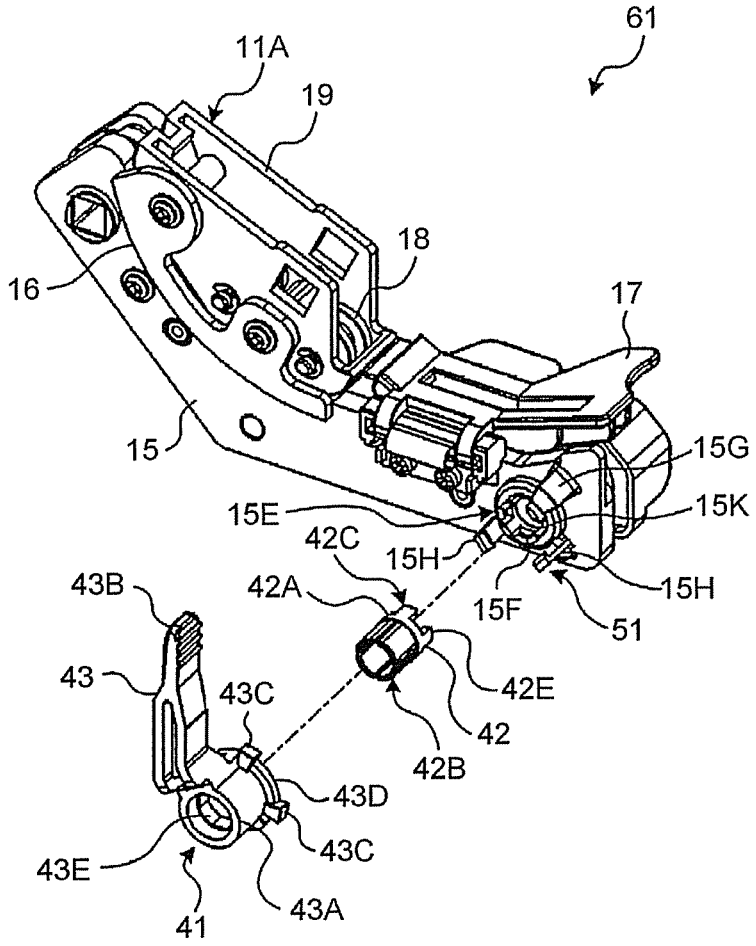
FIG. 10 is an exploded perspective view of the first movable unit shown in FIG. 6.

As shown in FIG. 4, the first fixing unit 41 is arranged at a position opposite to the second belt unit 11B with respect to the first belt unit 11A. The first fixing unit 41 is movably supported by the third guide shaft 13C in the axis 13CA direction of the third guide shaft 13C and is able to be fixed on the third guide shaft 13C. As shown in FIG. 10, the first fixing unit 41 comprises a cylinder member 41 and an operating member 43.

Figure 11:
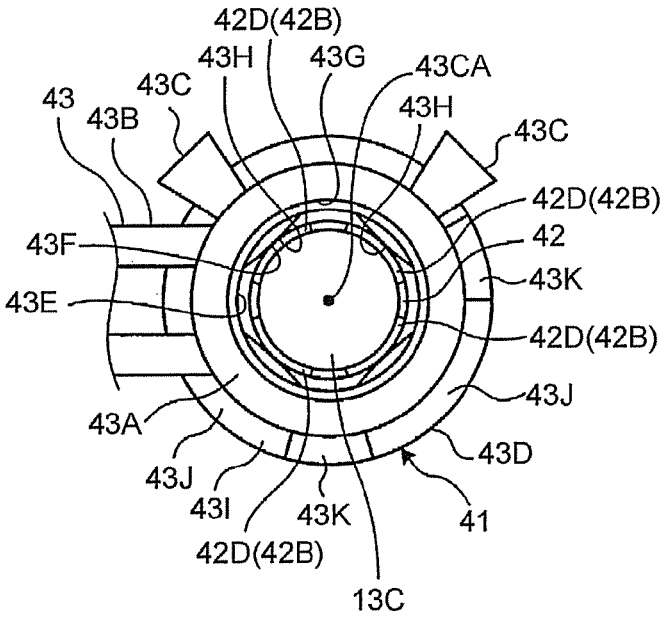
FIG. 11 is a side view of a part of the first movable unit shown in FIG. 6.
Figure 12:
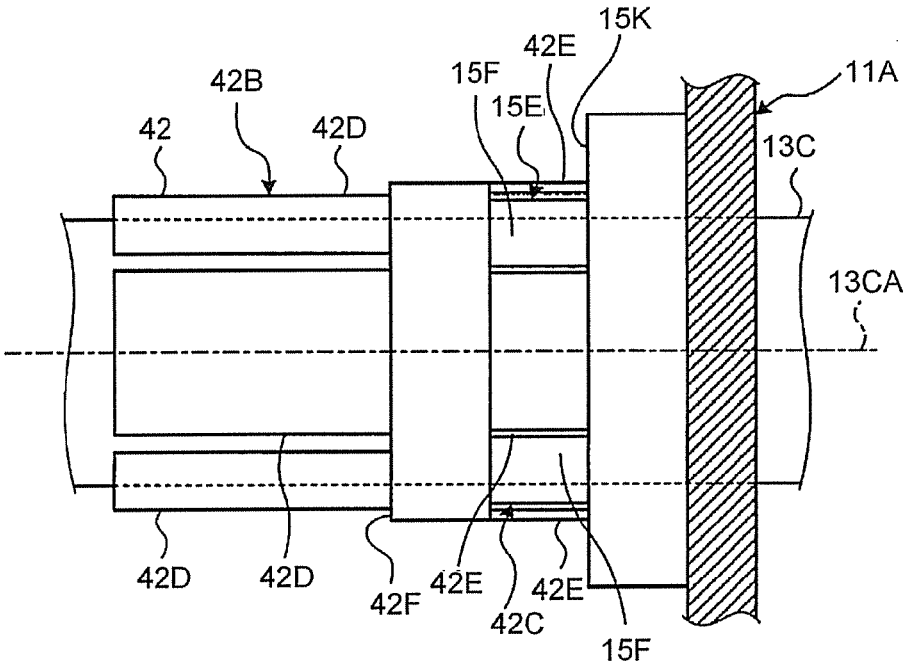
FIG. 12 is a side sectional view of a cylinder member and a part of the first movable unit according to the first embodiment.

As shown in FIG. 11, the cylinder member 42 is inserted into the operating member 43. Moreover, as shown in FIG. 12, the cylinder member 42 is connected with the first belt unit 11A. The cylinder member 42 is formed with a member separate from the first belt unit 11A and the operating member 43. Movement of the cylinder member 42 around the axis 13CA of the third guide shaft 13C is limited, as described in detail below.

Figure 13:
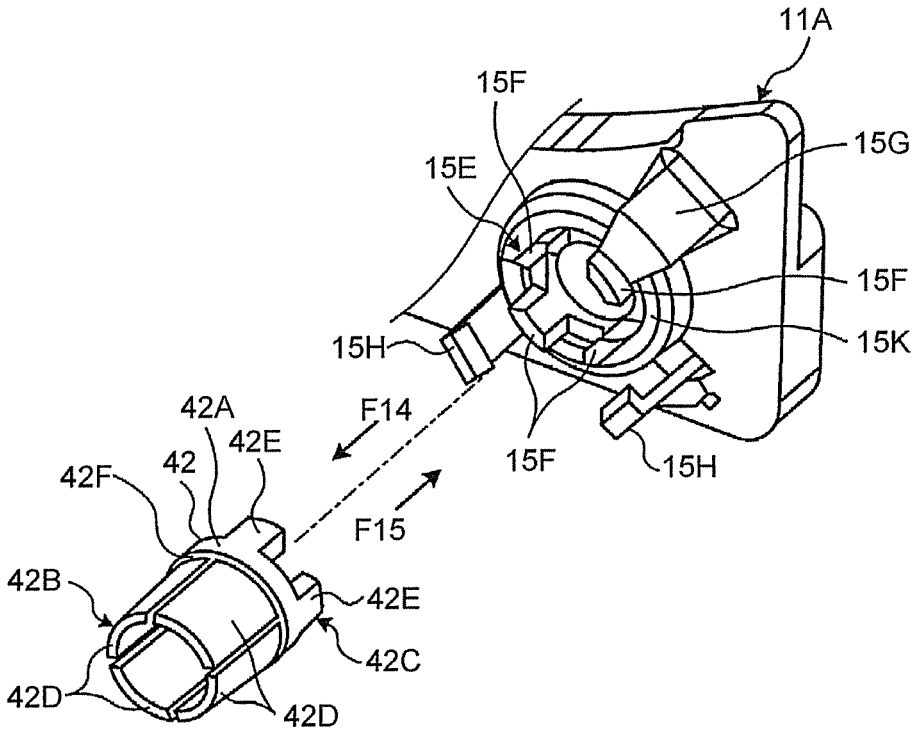
FIG. 13 is an exploded perspective view of the cylinder member and a part of the first movable unit according to the first embodiment.

As shown in FIG. 12 and FIG. 13, the cylinder member 42 comprises a cylinder part 42A, an elastic part 42B and a third clamping part 42C. The elastic part 42B is arranged at one end of the cylinder part 42A, and the third clamping part 42C is arranged at the other end of the cylinder part 42A. In the cylinder member 42, the third guide shaft 13C is inserted into the cylinder part 42A, the elastic part 42B and the third clamping part 42C.

The elastic part 42B comprises a plurality of elastically transformable elastic sheets 42D, which protrude from one of the ends of the cylinder part 42A along the axis 13CA direction of the third guide shaft 13C and are spaced each other by a distance around the axis 13CA of the third guide shaft 13C. That is, the elastic sheets 42D are supported by the cylinder part 42A in a cantilever structure.

Figure 14:
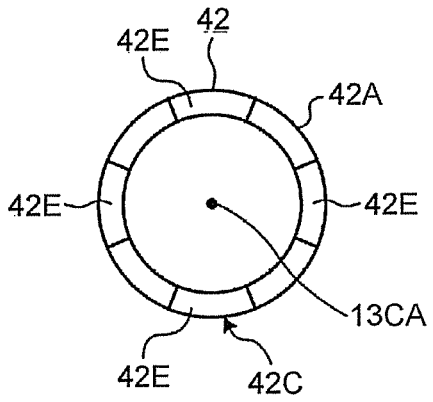
FIG. 14 is a diagram, showing the cylinder member, taken in the direction of the arrow F14 in FIG. 13 according to the first embodiment.

The third clamping part 42C comprises a plurality of first clamping sheets 42E, which protrude from the other end of the cylinder part 42A along the axis 13CA direction of the third guide shaft 13C. As shown in FIG. 14, the first clamping sheets 42E are arranged around the third guide shaft 13C and are spaced each other by a distance around the axis 13CA of the third guide shaft 13C. The third clamping part 42C is clamped with a fourth clamping part 15E (refer to FIG. 12) arranged on the first belt unit 11A.

As shown in FIG. 13, the fourth clamping part 15E is arranged on one side wall of the base 15 of the first belt unit 11A. The third guide shaft 13C (refer to FIG. 12) is inserted into the fourth clamping part 15E. The fourth clamping part 15E is clamped with the third clamping part 42C to limit the rotation of the cylinder member 42 around the axis 13CA of the third guide shaft 13C.

Figure 15:
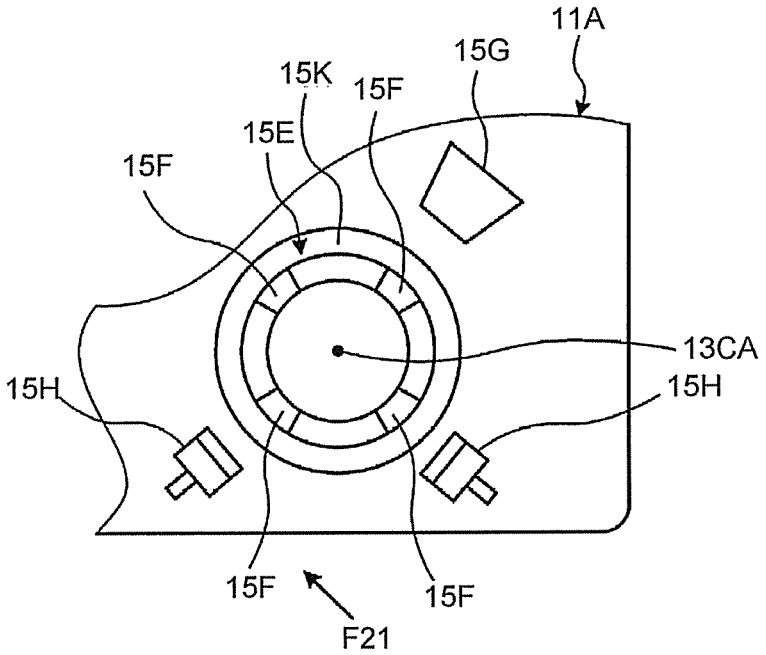
FIG. 15 is a diagram, showing the base of the first belt unit, taken in the direction of the arrow F15 in FIG. 13 according to the first embodiment.

As shown in FIG. 15, the fourth clamping part 15E comprises a plurality of second clamping sheets 15F which protrude in the axis 13CA direction of the guide shaft. The second clamping sheets 15F are arranged around the third guide shaft 13C and are spaced each other by a distance around the axis 13CA of the third guide shaft 13C. The second clamping sheets 15F are clamped with the first clamping sheets 42E (refer to FIG. 12). The fourth clamping part 15E is clamped with the third clamping part 42C to regulate the rotation of the cylinder member 42 around the axis 13CA of the third guide shaft 13C. Moreover, the fourth clamping part 15E is relatively movable with respect to the third clamping part 42C in the axis 13CA direction of the third guide shaft 13C.

Figure 16:
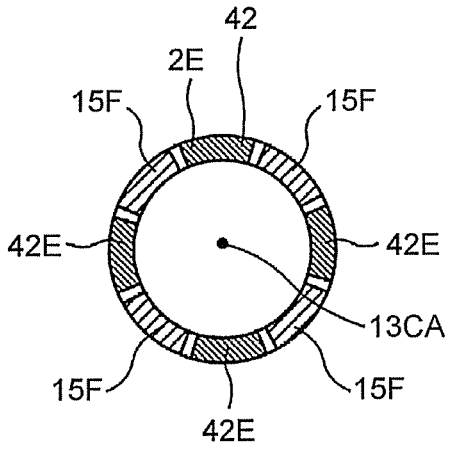
FIG. 16 is a side sectional view of a third and fourth clamping units according to the first embodiment.
Figure 16:
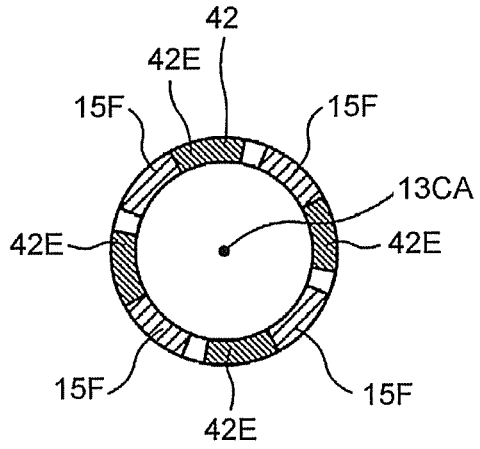

The third and the fourth clamping parts 42C and 15E connect the cylinder member 42 with the first belt unit 11A with a clearance around the axis 13CA of the third guide shaft 13C. As shown in FIG. 16, the third clamping part 42C and the fourth clamping part 15E is relatively movable by a given distance around the axis 13CA of the third guide shaft 13C. FIG. 16(A) shows a state in which the first clamping sheet 42E and the second clamping sheet 15F adjacent each other are far away from each other; FIG. 16 (B) shows a state in which the first clamping sheet 42E contacts one of the pair of second clamping sheets 15F adjacent thereto.

As shown in FIG. 10, the operating member 43 is arranged on a member separate from the first belt unit 11A. The cylinder member 42 (refer to FIG. 11) is inserted into the operating member 43 that is rotatable around the axis 13CA of the third guide shaft 13C between a fixed position (refer to FIG. 8) and a release position (refer to FIG. 7), the fixed position referring to a position where the operating member 43 fixes the first fixing unit 41 on the third guide shaft 13C by making the elastic part 42B of the cylinder member 42 forcibly contact the third guide shaft 13C and, the release position referring to a position where the operating member 43 releases the fixing of the third fixing unit 41 on the third guide shaft 13C by releasing the contact of the elastic part 42B of the cylinder member 42 against the third guide shaft 13C.

Figure 17:
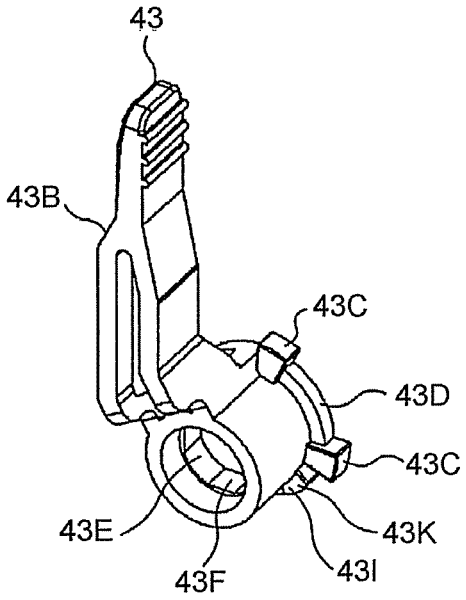
FIG. 17 is a perspective view of an operating member according to the first embodiment.
Figure 18:
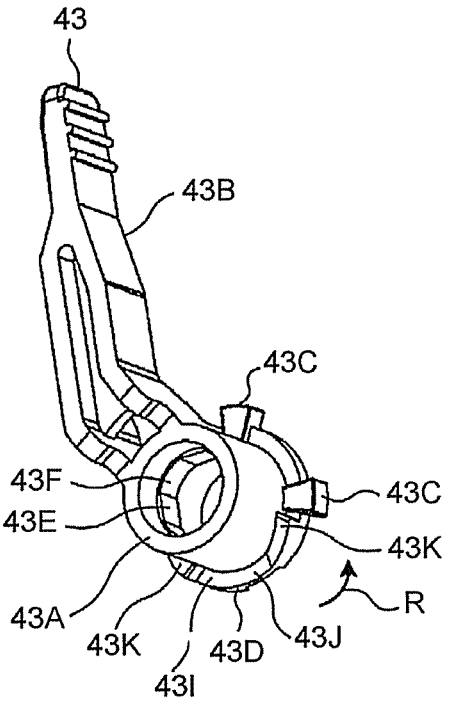
FIG. 18 is a perspective view of the operating member according to the first embodiment.

As shown in FIG. 17 and FIG. 18, the operating member 43 comprises a second cylinder part 43A and a push rod part 43B protruding from a part of the periphery of the second cylinder part 43A.

A flange 43D and a pair of cam parts 43C are arranged on the outer periphery at one end of the second cylinder unit 43A. The flange 43D and the pair of cam parts 43C are integrated with each other. The cam part pair 43C is arranged around the axis 13CA of the third guide shaft 13C to have a space therebetween. A base side cam unit 15G (refer to FIG. 7 and FIG. 13) that is arranged on one side wall of the base 15 of the first belt unit 11A is arranged between the cam unit pair 43C, and the pair of cam units 43C and the base side cam part 15G is movable with respect to each other (FIG. 7 and FIG. 8). When the operating member 43 is located at the fixed position, one of the cam parts 43C contacts the base side cam part 15G (FIG. 8). When the operating member 43 is located at the release position, the other cam part 43C contacts the base side cam part 15G (FIG. 7).

As shown in FIG. 17 and FIG. 18, an annular cam part 43E is arranged on the internal periphery of the second cylinder part 43A. The annular cam part 43E protrudes from the internal periphery of the second cylinder part 43A towards the center of the second cylinder part 43A and the annular contacting part 42F (refer to FIG. 12) of the cylinder member 42 contacts the annular cam part 43E to regulate the movement of the cylinder member 42 in the axis 13CA direction of the third guide shaft 13C.

Figure 19:
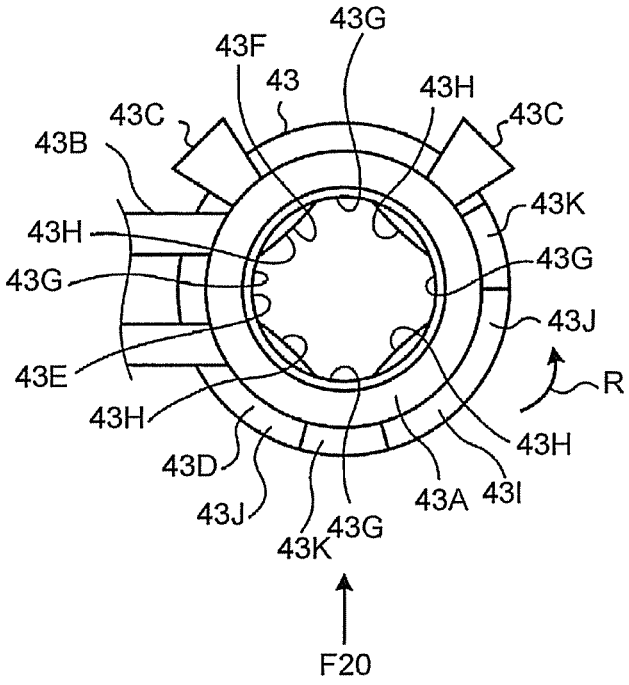
FIG. 19 is a side view of a part of the operating member according to the first embodiment.

As shown in FIG. 19, the top surface (the internal peripheral surface) of the annular cam part 43E is a cam surface 43F. First surfaces 43G formed into an arc shape and second surfaces 43H are alternately formed on the cam surface 43F in a circumferential direction. The second surfaces 43H are planes 43J that connect the ends of the first surfaces 43G. The distance between the centers of two opposite second surfaces 43H is shorter than that between the centers of two opposite first surfaces 43G. Moreover, when the operating member 43 is located at the fixed position, each second surface 43H is fixed at a position opposite to an elastic sheet 42D and presses the elastic sheet 42D towards the third guide shaft 13C to forcibly contact the elastic sheet 42D onto the third guide shaft 13C (refer to FIG. 11). Thus, the first fixing unit 41 is fixed on the third guide shaft 13C. In this case, if the operating member 43 is located at the release position, then each first surface 43G is located at a position opposite to the elastic sheet 42D, the press of the second surface 43H on the elastic sheet 42D is released to release the pressed connection between the elastic sheet 42D and the third guide shaft 13C, thereby releasing the fixing of the first fixing unit 41 on the third guide shaft 13C.

Figure 20:
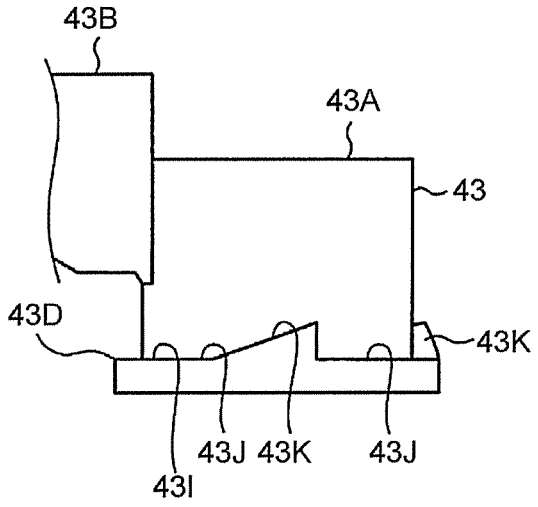
FIG. 20 is a view taken in the direction of the arrow F20 in FIG. 19.

As shown in FIG. 19 and FIG. 20, the flange 43D, which is formed into an annular shape, protrudes from the external peripheral surface of the second cylinder part 43A.

As shown in FIG. 13, the first connecting unit 51 comprises a pair of claw members 15H that serve as the first clamping unit of the first belt unit 11A and flanges 43D that serve as the second clamping unit of the operating member 43. In the first connecting unit 51, the first fixing unit 41 is connected with the first belt unit 11A with a clearance in the axis 13CA direction of the third guide shaft 13C by the connection of the first clamping unit pair and the flange 43D. Moreover, the first clamping unit may also be arranged on the operating member 43, and the second clamping unit may be arranged on the first belt unit 11A. That is, the first clamping unit is arranged on either of the operating member 43 and the first belt unit 11A and the second clamping unit is arranged on the other one.

Figure 21:
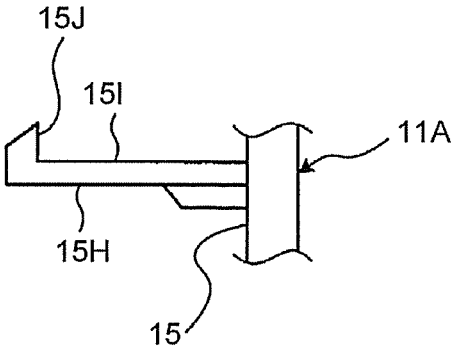
FIG. 21 is a diagram, showing the claw member, taken in the direction of the arrow F21 in FIG. 15 according to the first embodiment.

As shown in FIG. 15, the pair of claw members 15H, which are arranged on one side wall of the base 15 of the first belt unit 11A around the fourth clamping unit 15E, are arranged around the axis 13CA of the third guide shaft 13C to have a space each other. As shown in FIG. 21, the claw member 15H comprises a base 15I that is vertically arranged on one side wall of the base 15 of the first belt unit 11A and a contacting unit 15J that is arranged in a curved manner with respect to the front end of the base 15I and is able to contact one side 43I of the flange 43D.

As shown in FIG. 19 and FIG. 20, a plane 43J which is substantially orthogonal to the axis 13CA direction of the third guide shaft 13C and a guide surface 43K which is inclined with respect to the plane 43J are arranged on the side 43I of the flange 43D of the operating member 43. The plane 43J and the guide surface 43K are clamped with the claw member 15H.

The height of the guide surface 43K increases continuously with respect to the plane 43J with the forward movement of the operating member 43 in the rotation direction from the release position to the fixed position (the direction indicated by the arrow R shown in FIG. 6 and FIG. 18). When the operating member 43 is located at the fixed position, the plane 43J is opposite to the contacting unit 15J of the claw member 15J, and when the operating member 43 is located at the release position, the top of the guide surface 43K is opposite to the contacting unit 15J of the claw member 15J. The flange 43D having the above structure enables the distance moved by the first belt unit 11A with respect to the fixing unit in the axis 13CA direction of the third guide shaft 13C when the operating member 43 is located at the fixed position to be greater than that (clearance) moved by the first belt unit 11A with respect to the fixing unit in the axis 13CA direction of the third guide shaft 13C when the operating member 43 is located at the release position.

Figure 22:
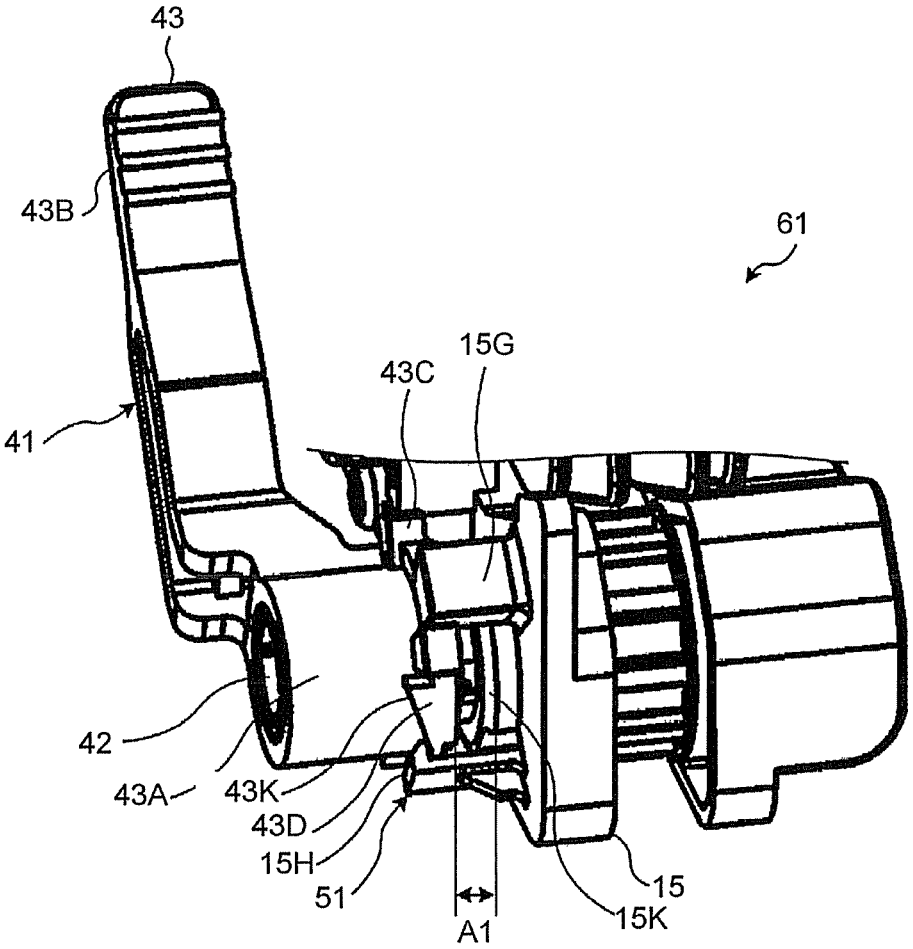
FIG. 22 is a perspective view of the first movable unit according to the first embodiment wherein the operating member is located at the fixed position.
Figure 23:
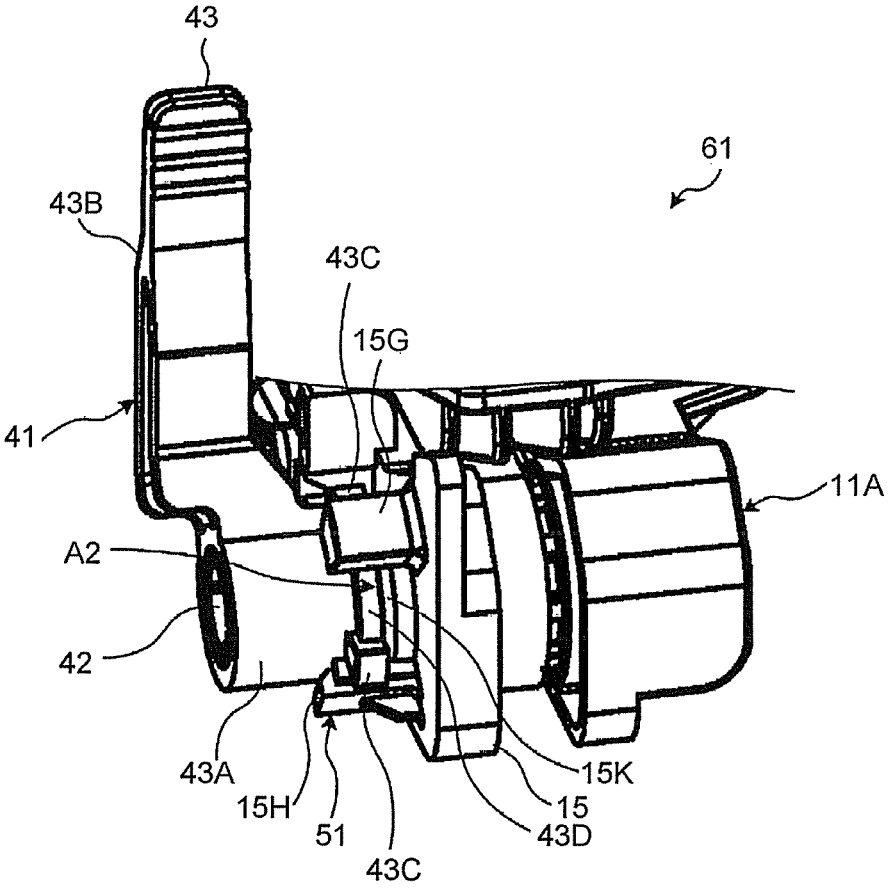
FIG. 23 is a perspective view of the first movable unit according to the first embodiment provided with wherein the operating member is located at the release position.

Here, FIG. 22 shows a state in which the claw member 15H contacts the plane 43J of the flange 43D when the operating member 43 is located at the fixed position. In this state, a given clearance A1 is formed between the end part of the second cylinder part 43A of the operating member 43 and the annular contacting unit 15K arranged on the base 15 of the first belt unit 11A, and the first belt unit 11A is able to move the clearance A1 in a direction away from the first fixing unit 41 (the direction in which the tension of the tractor paper 6 is restrained), that is, a direction approaching the second belt unit 11B. FIG. 23 shows a state in which the claw member 15H contacts the top of the guide surface 43K (refer to FIG. 18) of the flange 43D when the operating member 43 is located at the release position. In this state, the clearance A2 between the end part of the second cylinder part 43A of the operating member 43 and the annular contacting part 15K arranged on the base of the first belt unit 11A is approximate to or equal to 0, smaller than the clearance shown in FIG. 22.

Figure 24:
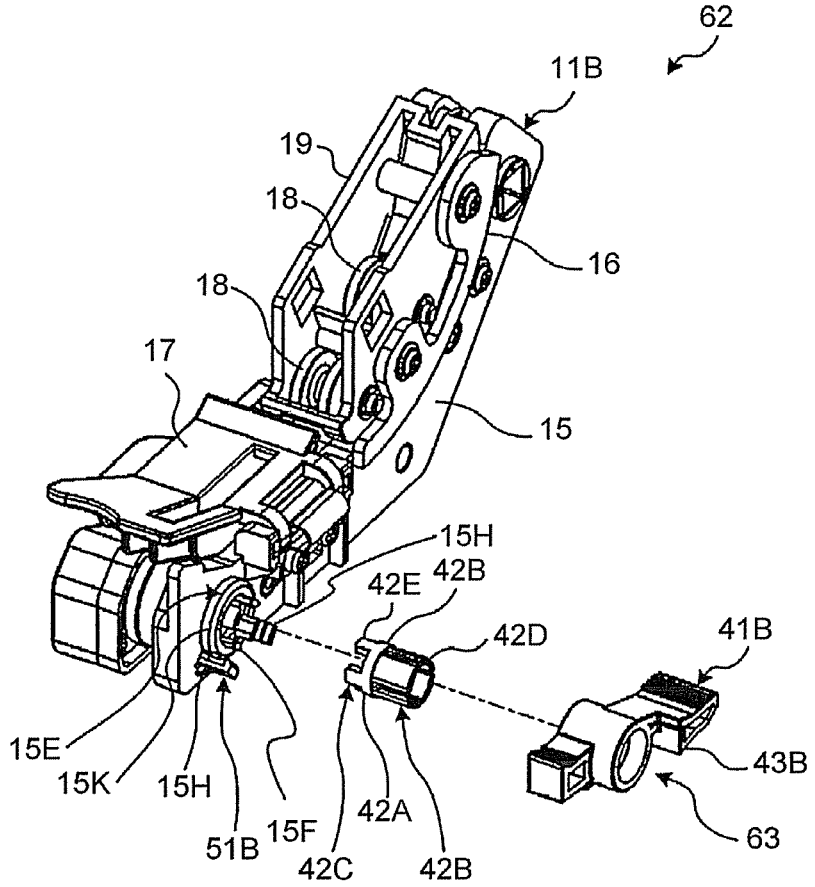
FIG. 24 is an exploded perspective view of a second movable unit according to the first embodiment.

As shown in FIG. 24, the second belt unit 11B is connected with a second fixing unit 41B via a second connecting part 51B. The second belt unit 11B, the second fixing unit 41B and the second connecting part 51B together constitute a second movable unit 62.

The second fixing unit 41B and the first fixing unit 41, as well as the second connecting part 51B and the first connecting part 51, are substantially structurally identical to each other and symmetrical to each other with respect to a surface orthogonal to the axis 13CA of the third guide shaft 13C as the symmetry axis. That is, the second fixing unit 41B comprises a cylinder member 42B and an operating member 43B, and the second connecting part 51B comprises claw members 15H arranged on the base 15 of the second belt unit 11B and flanges 43DB arranged on the cylinder members 42. The cylinder member 42B is identical in structure to but opposite in installation direction to the cylinder member 42. The second fixing unit 41B having the above structure is arranged to position (fix) the second belt unit 11B in the axis 13CA direction of the third guide shaft 13C. Moreover, the second connecting part 51B, which is spaced by a clearance from the axis 13CA of the third guide shaft 13C, connects the second belt unit 11B with the third guide shaft 13C. The second fixing unit 41B and the second connecting part 51B constitute a positioning unit 63.

The differences of the second fixing unit 41B and the second connecting part 51B from the first fixing unit 41 and the first connecting part 51 are illustrated below.

A pair of push rods 43BB, which is shorter in length than those of the first fixing unit 41, are arranged on the operating member 43B of the second fixing unit 41B.

Figure 25:
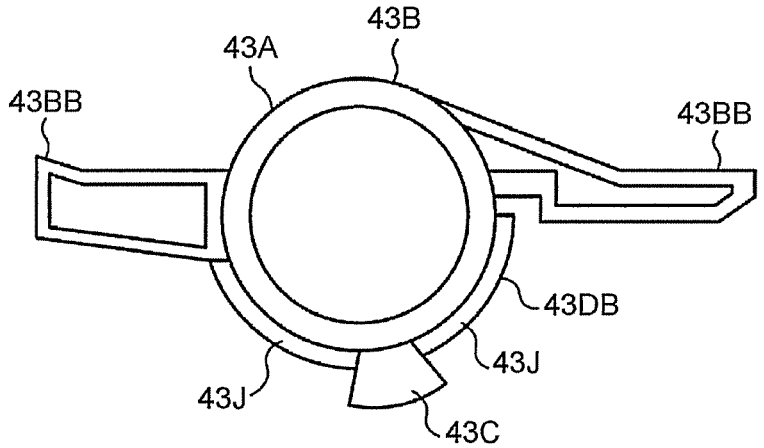
FIG. 25 is a side view of the operating member of the second movable unit according to the first embodiment.

Further, as shown in FIG. 25, the flange 43DB of the first connecting part 51 is formed into an arc shape. Moreover, only a plane 43J, but not a guide surface 43K, is arranged on the flange 43DB. Therefore, the second connecting part 51B connects the second belt unit 11B with the second fixing unit 41B in a state that the second connecting part 51B has substantially no clearance in the axis 13CA direction of the third guide shaft 13C.

Next, an example of a method for setting the tractor paper 6 on the tractor 9 is described below. First, an operator fixes the second belt unit 11B on the third guide shaft 13C using the second fixing unit 41B. Then, the push rod 43B of the first fixing unit 41 is rotated to the release position to release the fixing of the first fixing unit 41 on the third guide shaft 13C by the first fixing unit 41. Sequentially, the first belt unit 11A is moved in the axis 13CA direction of the third guide shaft 13C to match the clearance between the first belt unit 11A and the second belt unit 11B with the width of the tractor paper 6 to be set.

Next, the pins 14B of the second belt unit 11B are inserted into one row of the feeding holes 6C formed on the tractor paper 6, and the pins 14B of the first belt unit 11A are inserted into the other row of the feeding holes. The movable covers 17 are then closed. Sequentially, the push rod 43B of the first fixing unit 41 is rotated to the fixed position to fix the first fixing unit 41 on the third guide shaft 13C, thereby setting the tractor paper 6 on the tractor 9. At this time, if the distance between the first belt unit 11A and the second belt unit 11B is set to be wider than a distance proper for the conveying of the tractor paper 6, then the tractor paper 6 is pulled in the width direction. In this case, the first belt unit 11A is connected with the first fixing unit 41, with a clearance reserved between the first belt unit and the axis 13CA direction of the third guide shaft 13C, thus, by means of the restoring force of the tractor paper 6, the second belt unit 11B resists the elastic force of the coil springs 60 to move towards the second belt unit 11B. Moreover, the first belt unit 11A is stopped by balancing the forces applied by different members. The tension of the tractor paper 6 is relieved by the movement of the first belt unit 11A. In such a manner, the tractor paper 6 can be conveyed smoothly.

As stated above, in this embodiment, the first connecting part 51 connects the first belt unit 11A with the first fixing unit 41 with a clearance in the axis 13CA direction of the third guide shaft 13C. Thus, the tension of the tractor paper 6 can be relieved even if the distance between the pair of belt units 11 is set to be greater than a proper distance that the tractor paper 6 is smoothly fed. Thus, the tractor paper 6 is kept in a proper tensioned state.

In this embodiment, as the cylinder member 42 and the operating member 43 of the first fixing unit 41 are arranged on a member separate from the first belt unit 11A, the tension of the tractor paper 6 may be relieved by moving the cylinder member 42 and the operating member 43 with respect to the first belt unit 11A.

Moreover, in this embodiment, the flange 43D serving as the second clamping part enables the distance (movable amount) moved by the first belt unit 11A with respect to the first fixing unit 41 in the axis 13CA direction of the third guide shaft 13C when the operating member 43 is located at the fixed position to be greater than that moved by the first belt unit 11A with respect to the fixing unit 41 in the axis 13CA direction of the third guide shaft 13C when the operating member 43 is located at the release position. Therefore, when the operating member 43 is rotated from the release position to the fixed position to fix the first fixing unit 41 to the third guide shaft 13C, the distance that may be moved by the first belt unit 11A in the axis 13CA direction with respect to the first fixing unit 41 is increased to relieve the tension of the tractor paper 6.

Moreover, when the operating member 43 is located at the release position, the distance that may be moved by the first belt unit 11A in the axis 13CA direction with respect to the first fixing unit 41 is very short or even equal to 0. Therefore, it can prevent that the first fixing unit 41 and the first belt unit 11A are separated greatly when the first fixing unit 41 is released from the fixing on the third guide shaft 13C.

Moreover, in this embodiment, the fourth clamping part 15E is clamped with the third clamping part 42C to regulate the rotation of the cylinder member 42 around the axis 13CA of the third guide shaft 13C. Therefore, the rotation of the cylinder member 42 provided with the third clamping part 42C around the axis 13CA of the third guide shaft 13C is restrained when the push rod 43B is rotating.

Further, in this embodiment, the third and the fourth clamping parts 42C and 15E connect the cylinder member 42 with the first belt unit 11A with a clearance around the axis 13CA of the third guide shaft 13C. Therefore, the first clamping sheets 42E of the third clamping part 42C are spaced from the second clamping sheets 15F of the fourth clamping part 15E around the axis 13CA of the third guide shaft 13C, that is, there is no friction between the first clamping sheets 42E and the second clamping sheets 15F. In this case, the fourth clamping part 15E can be moved smoothly without friction between the first clamping sheets 42E and the second clamping sheets 15F of the fourth clamping part 15E in a direction away from the third clamping unit 42C (the direction in which the tension of the tractor paper 6 is relieved).

Further, in this embodiment, the first belt unit 11A and the cylinder member 42 are connected with each other around the axis 13CA of the third guide shaft 13C with a clearance therebetween, and the positioning unit 63 connects the second belt unit 11B with a clearance around the axis 13CA of the third guide shaft 13C. Further, the third guide shaft 13C is rotatable around the axis 13CA of the third guide shaft 13C. Therefore, in a state that the first fixing unit 41 and the second fixing unit 41B are fixed on the third guide shaft 13C, the third clamping part 42C of the cylinder member 42 arranged in the first fixing unit 41 fixed on the third guide shaft 13C can be rotated with respect to the fourth clamping part 15E of the first belt unit 11A by rotating the third guide shaft 13C around the axis 13CA thereof. As a result, the first clamping sheets 42E of the third clamping part 42C are easily spaced from the second clamping sheets 15F of the fourth clamping part 15E around the axis 13CA of the third guide shaft 13C, that is, there is no friction between the first clamping sheets 42E and the second clamping sheets 15F.

In addition, an example of the second belt unit 11B movable in the axis 13CA direction of the third guide shaft 13C is described in this embodiment, however, it is not limited to this, the second belt unit 11*b* may be always fixed on the third guide shaft 13C.

Second Embodiment

In the second embodiment shown in FIG. 26-FIG. 30, a first movable unit 161 is different from the first movable unit 61 described in the first embodiment, while other members are identical to those described in the first embodiment. Moreover, these identical members are applied with the same reference numerals hereinafter and are therefore not described repeatedly.

Figure 26:
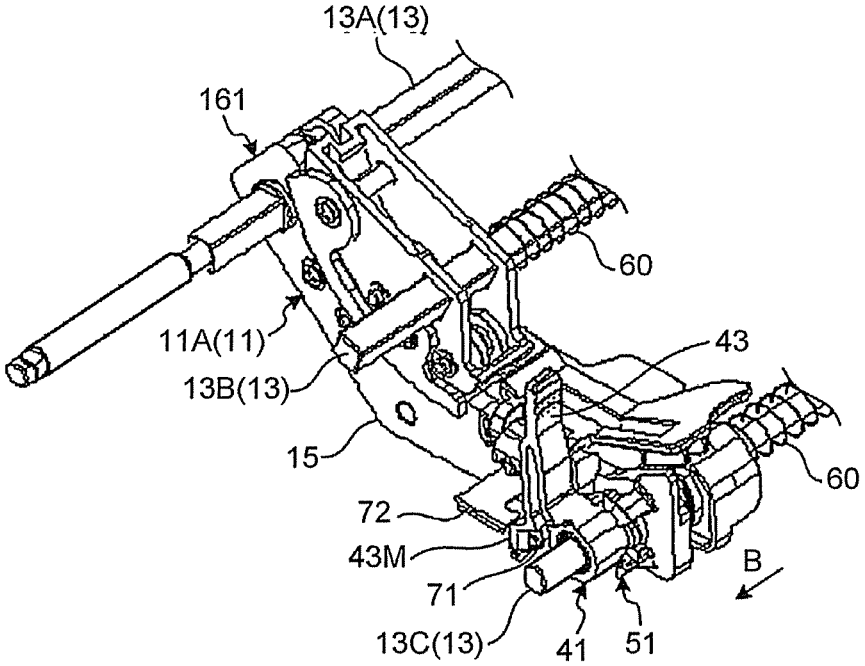
FIG. 26 is a perspective view of a part of the tractor according to a second embodiment.
Figure 27:
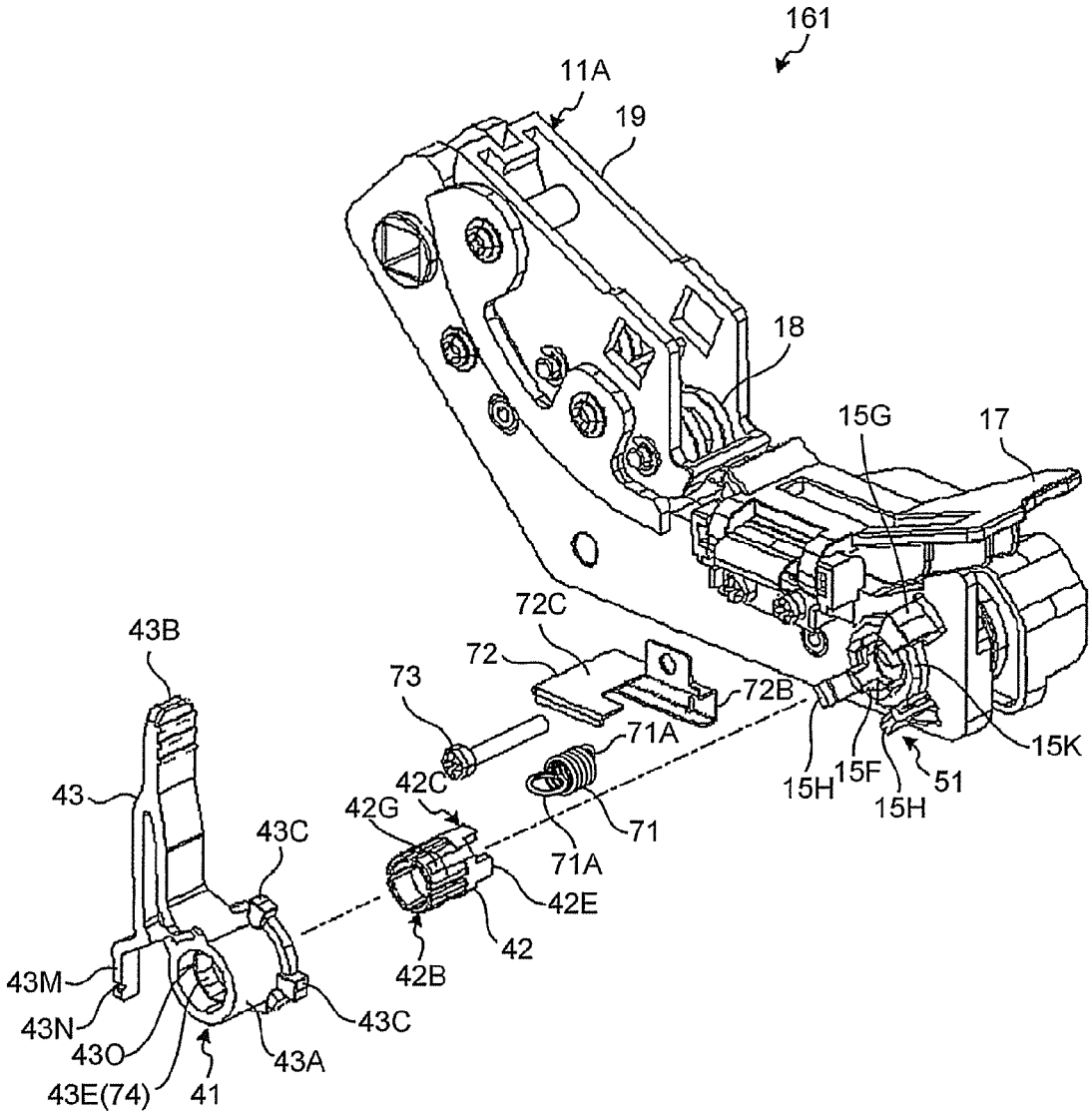
FIG. 27 is an exploded perspective view of the first movable unit according to the second embodiment.

As shown in FIG. 26 and FIG. 27, in addition to the first belt unit 11A, the first fixing unit 41 and the first connecting unit 51, the first movable unit 161 further comprises a coil spring 71 serving as an urging member.

Figure 28:
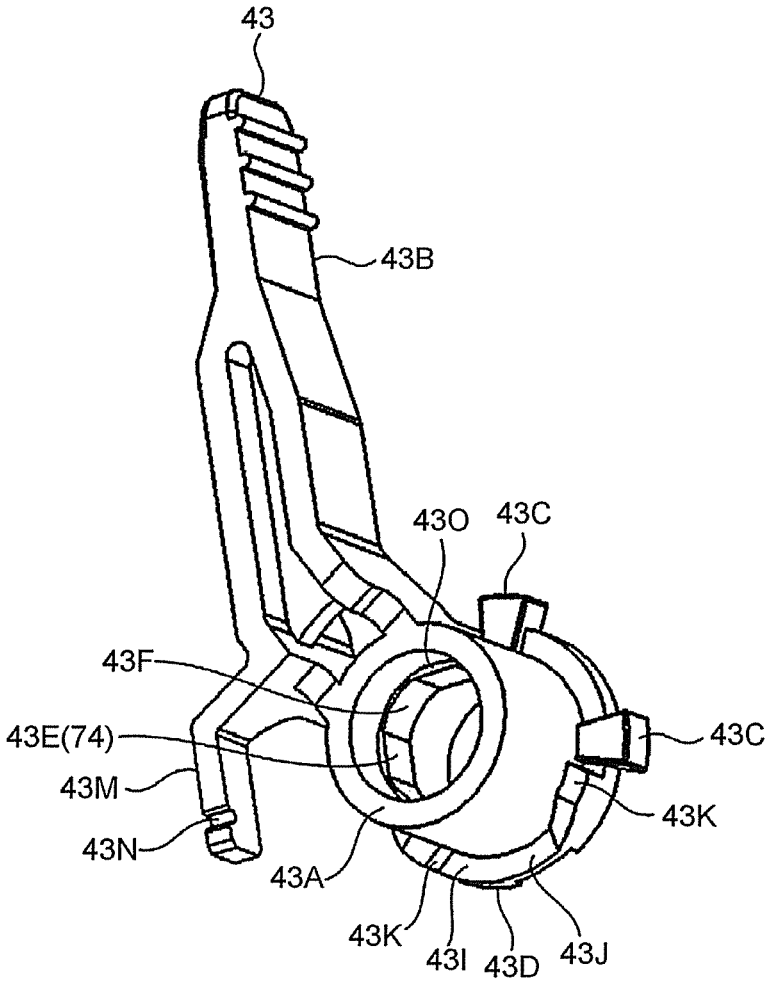
FIG. 28 is a perspective view of the operating member according to the second embodiment.

The coil spring 71 is located between the operating member 43 and the first belt unit 11A, with one end thereof supported by the operating member 43 and the other end thereof supported by the first belt unit 11A. Specifically, a ring 71A is arranged at each end of the coil spring 71. On the other hand, an arm-shaped extension part 43M is arranged on the push rod unit 43B of the operating member 43, as shown in FIG. 28. Further, the ring 71A at one end of the coil spring 71 is hooked on the concave hook part 43N of the extension part 43M (FIG. 26). Further, as shown in FIG. 26 and FIG. 27, the first belt unit 11A comprises a cover member 72. The ring 71A at the other end of the coil spring 71 is hooked on a hook part (not shown) arranged on the cover member 72. The coil spring 71 functions as a tension spring. Specifically, the coil spring 71 urges the first belt unit 11A in a direction away from the second belt unit 11B. Therefore, the coil spring 71 applies a tensile force to the tractor paper 6 set on the first belt unit 11A and the second belt unit 11B. Moreover, the tensile force applied by the coil spring 71 is set properly to apply a proper tension to the tractor paper 6.

Here, the cover member 72, which is arranged on the base 15 of the first belt unit 11A opposite to the second belt unit 11B, comprises a base 72B and a plate-shaped cover 72C that extends from the base 72B. The base 72B is combined with the base 15 via a connecting tool (e.g. bolt). The cover 72C covers the coil spring 71, and specifically, the cover 72C covers the upper inclined part of the coil spring 71.

Figure 29:
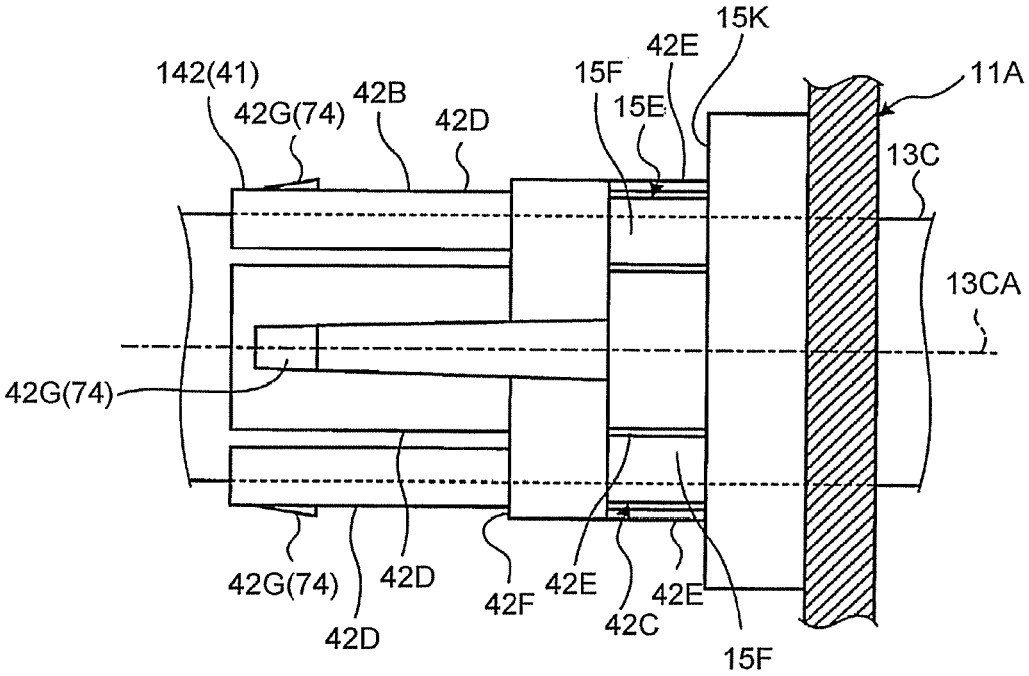
FIG. 29 is a side sectional view of the cylinder member and a part of the first movable unit according to the second embodiment.
Figure 30:
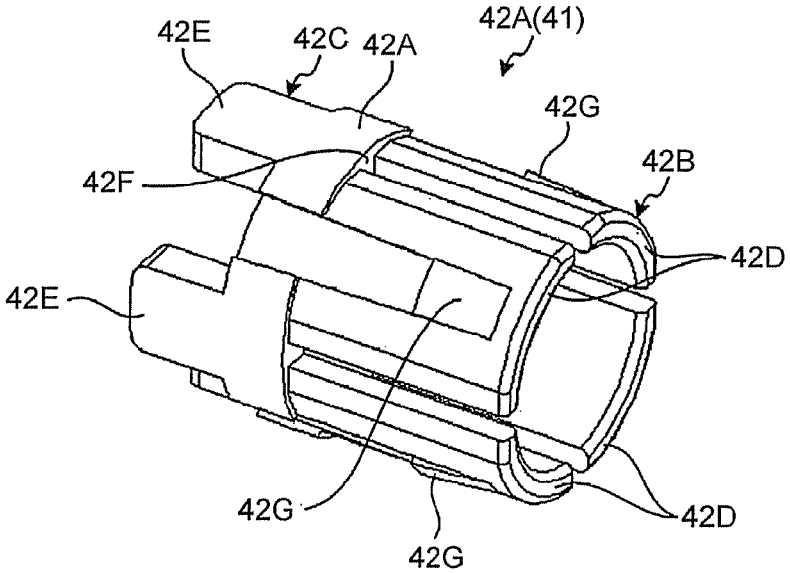
FIG. 30 is a perspective view of the cylinder member according to the second embodiment.

Moreover, in this embodiment, as shown in FIG. 29 and FIG. 30, a plurality of claw parts 42G are arranged on the outer periphery of the cylinder member 142 of the first fixing unit 41. The claw parts 42G are arranged on the elastic sheets 42D of the cylinder member 142. The claw parts 42G protrude from the elastic sheets 42D towards the outside of the cylinder member 142 and are clamped (hooked) with the annular cam parts 43E (refer to FIG. 28) arranged on the second cylinder unit 43A of the operating member 43. Specifically, the claw parts 42G are clamped with the ends 43O of the annular cam parts 43E opposite to the first belt unit 11A. The claw parts 42G together with the annular cam parts 43E constitute a second restriction unit 74, which regulates the movement of the operating unit 43 that it moves towards front lower side in FIG. 26 with respect to the cylinder member 142. That is, the second restriction unit 74 regulates the movement of the operating member 43 with respect to the cylinder member 142 toward the direction B of decreasing a looseness (clearance) in the direction that the first belt unit 11A goes to the second belt unit 11B in a loseness of the first connecting unit 51.

As stated above, in this embodiment, the coil spring 71 applies a pressure to the first belt unit 11A to move the first belt unit 11A in a direction away from the second belt unit 11B. Therefore, the tractor paper 6 set on the first belt unit 11A and the second belt unit 11B is subjected to a proper tension under the pressure applied by the coil spring 71, thereby preventing the tractor paper 6 from being sagged down under the weight of the tractor paper because of losing the tension applied to the tractor paper 6. Consequentially, the tractor paper 6 can be printed in an excellent way.

Moreover, in this embodiment, as the cover member 72 covers the coil spring 71, the coil spring 71 can be protected with the cover member 72. Here, in an example of the setting of the tractor paper 6, the operator starts operation from the front side of the main body 2 and will therefore possibly touch the coil spring 71 if no cover member 72 is arranged. Contrarily, in this embodiment, the coil spring 71 is covered with the cover member 72, thus, the touch of the operator with the coil spring 71 is avoided.

Moreover, in this embodiment, the second restriction unit 74 regulates the movement of the operating member 43 with respect to the cylinder member 142 toward the direction B of decreasing a clearance in the direction that the first belt unit 11A goes to the second belt unit 11B in a clearance of the first connecting unit 51.

Here, when the process of setting the tractor paper 6, in order to rotate the operating member 43 (push rod unit 43B) to the fixed position, the operator may apply a force to the operating member 43 towards the front lower direction (direction B) shown in FIG. 26. In this case, the second restriction unit 74 regulates the movement in this embodiment. Therefore, in the case where the tractor paper 6 is set, the clearance in the direction B in which the first belt unit 11A goes toward the second belt unit 11B in the clearance of the second connecting unit 51 may be effectively guaranteed.

As stated above, in accordance with the first and the second embodiments, the tension of the tractor paper may be relieved even if the tractor paper is set on the tractor such that the tractor paper is overly extended or pulled in the width direction thereof.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A tractor, comprising:

a guide shaft;

a first belt unit, supported by the guide shaft so as to move in an axis direction of the guide shaft, which includes a rotatable endless pin belt which is provided with a plurality of pins inserting into one of a pair of feeding hole lines formed on a tractor paper;

a second belt unit, arranged to face the first belt unit in the axis direction of the guide shaft and supported by the guide shaft, which includes a rotatable endless pin belt which is provided with a plurality of pins inserting into the other feeding hole line formed on the tractor paper;

a fixing unit, which is movably supported by the guide shaft in the axis direction of the guide shaft and is capable of being fixed on the guide shaft; and a connecting unit configured to connect the first belt unit to the fixing unit with a clearance in the axis direction of the guide shaft;

wherein the fixing unit includes:

a cylinder member having an elastic part into which the guide shaft is inserted, wherein the cylinder member is arranged on a member that is a different member from the first belt unit to regulate the movement of the first belt unit around the axis of the guide shaft; and an operating member, which is arranged on a member that is a different member from the first belt unit, into which the cylinder member is inserted, and which is able to move around the axis of the guide shaft at between a fixed position where the elastic part is pressed to forcibly contact the guide shaft so as to fix the fixing unit on the guide shaft and a release position where the fixing of the fixing unit on the guide shaft is released by releasing the pressed connection between the fixing unit and the guide shaft;

the cylinder member includes:

a cylinder unit, having one end of which is provided with the elastic part and inserted with the guide shaft; and a third clamping part arranged at the other end of the cylinder unit; and the first belt unit includes:

a fourth clamping part, clamping with the third clamping part to regulate the rotation of the cylinder member around the axis of the guide shaft, which is able to move relatively with respect to the third clamping part in the axis direction of a third guide shaft;

the elastic part includes a plurality of elastic sheets;

the third clamping part includes a plurality of first clamping sheets; and the fourth clamping part includes a plurality of second clamping sheets;

wherein the plurality of elastic sheets extend from one end of the cylinder unit along the axis direction of the guide shaft and are arranged with a space each other around the axis of the guide shaft;

the plurality of first clamping sheets extend from the other end of the cylinder unit along the axis direction of the guide shaft and are arranged with a space each other around the axis of the guide shaft; and the plurality of second clamping sheets extend along the axis direction of the guide shaft and are arranged with a space each other around the axis of the guide shaft to clamp with the first clamping sheets.

2. The tractor according to claim 1, wherein the connecting unit includes:

a first clamping part arranged on either of the operating member and the first belt unit; and a second clamping part arranged on the other one of the operating member and the first belt unit and clamped with the first clamping part to increase a movable distance of the first belt unit with respect to the fixing unit in the axis direction of the guide shaft when the operating member is located at the fixed position compared with a movable distance of the first belt unit with respect to the fixing unit in the axis direction of the guide shaft when the operating member is located at the release position.

3. A tractor, comprising:

a guide shaft;

a first belt unit, supported by the guide shaft so as to move in an axis direction of the guide shaft, which includes a rotatable endless pin belt which is provided with a plurality of pins inserting into one of a pair of feeding hole lines formed on a tractor paper;

a second belt unit, arranged to face the first belt unit in the axis direction of the guide shaft and supported by the guide shaft, which includes a rotatable endless pin belt which is provided with a plurality of pins inserting into the other feeding hole line formed on the tractor paper;

a fixing unit, which is movably supported by the guide shaft in the axis direction of the guide shaft and is capable of being fixed on the guide shaft; and a connecting unit configured to connect the first belt unit to the fixing unit with a clearance in the axis direction of the guide shaft;

wherein the fixing unit includes:

a cylinder member having an elastic part into which the guide shaft is inserted, wherein the cylinder member is arranged on a member that is a different member from the first belt unit to regulate the movement of the first belt unit around the axis of the guide shaft; and an operating member, which is arranged on a member that is a different member from the first belt unit, into which the cylinder member is inserted, and which is able to move around the axis of the guide shaft at between a fixed position where the elastic part is pressed to forcibly contact the guide shaft so as to fix the fixing unit on the guide shaft and a release position where the fixing of the fixing unit on the guide shaft is released by releasing the pressed connection between the fixing unit and the guide shaft;

the cylinder member includes:

a cylinder unit, having one end of which is provided with the elastic part and inserted with the guide shaft; and a third clamping part arranged at the other end of the cylinder unit; and the first belt unit includes:

a fourth clamping part, clamping with the third clamping part to regulate the rotation of the cylinder member around the axis of the guide shaft, which is able to move relatively with respect to the third clamping part in the axis direction of a third guide shaft a positioning unit configured to position the second belt unit in the axis direction of the guide shaft and connect with a clearance the second belt unit to the guide shaft around the axis of the guide shaft; and a first restriction unit configured to regulate the rotation of the first and the second belt units around the axis of the guide shaft; wherein the guide shaft is rotatable around the axis of the guide shaft; and the third clamping part and the fourth clamping part connect with a clearance the cylinder unit to the first belt unit around the axis of the guide shaft.

4. A printer, comprising:

a tractor, including;

a guide shaft;

a first belt unit, supported by the guide shaft so as to move in an axis direction of the guide shaft, which includes a rotatable endless pin belt which is provided with a plurality of pins inserting into one of a pair of feeding hole lines formed on a tractor paper;

a second belt unit, arranged to face the first belt unit in the axis direction of the guide shaft and supported by the guide shaft, which includes a rotatable endless pin belt which is provided with a plurality of pins inserting into the other feeding hole line formed on the tractor paper;

a fixing unit, which is movably supported by the guide shaft in the axis direction of the guide shaft and is capable of being fixed on the guide shaft; and a connecting unit configured to connect the first belt unit to the fixing unit with a clearance in the axis direction of the guide shaft;

wherein the fixing unit includes:

a cylinder member having an elastic part into which the guide shaft is inserted, wherein the cylinder member is arranged on a member that is a different member from the first belt unit to regulate the movement of the first belt unit around the axis of the guide shaft; and an operating member, which is arranged on a member that is a different member from the first belt unit, into which the cylinder member is inserted, and which is able to move around the axis of the guide shaft at between a fixed position where the elastic part is pressed to forcibly contact the guide shaft so as to fix the fixing unit on the guide shaft and a release position where the fixing of the fixing unit on the guide shaft is released by releasing the pressed connection between the fixing unit and the guide shaft;

the cylinder member includes:

a cylinder unit, having one end of which is provided with the elastic part and inserted with the guide shaft; and a third clamping part arranged at the other end of the cylinder unit; and the first belt unit includes:

a fourth clamping part, clamping with the third clamping part to regulate the rotation of the cylinder member around the axis of the guide shaft, which is able to move relatively with respect to the third clamping part in the axis direction of a third guide shaft;

the elastic part includes a plurality of elastic sheets;

the third clamping part includes a plurality of first clamping sheets; and the fourth clamping part includes a plurality of second clamping sheets;

wherein the plurality of elastic sheets extend from one end of the cylinder unit along the axis direction of the guide shaft and are arranged with a space each other around the axis of the guide shaft;

the plurality of first clamping sheets extend from the other end of the cylinder unit along the axis direction of the guide shaft and are arranged with a space each other around the axis of the guide shaft; and the plurality of second clamping sheets extend along the axis direction of the guide shaft and are arranged with a space each other around the axis of the guide shaft to clamp with the first clamping sheets.

5. The printer according to claim 4, wherein the connecting unit includes:

a first clamping part arranged on either of the operating member and the first belt unit; and a second clamping part arranged on the other one of the operating member and the first belt unit and clamped with the first clamping part to increase a movable distance of the first belt unit with respect to the fixing unit in the axis direction of the guide shaft when the operating member is located at the fixed position compared with a movable distance of the first belt unit with respect to the fixing unit in the axis direction of the guide shaft when the operating member is located at the release position.

6. A printer, comprising:

a tractor, including;

a guide shaft;

a first belt unit, supported by the guide shaft so as to move in an axis direction of the guide shaft, which includes a rotatable endless pin belt which is provided with a plurality of pins inserting into one of a pair of feeding hole lines formed on a tractor paper;

a second belt unit, arranged to face the first belt unit in the axis direction of the guide shaft and supported by the guide shaft, which includes a rotatable endless pin belt which is provided with a plurality of pins inserting into the other feeding hole line formed on the tractor paper;

a fixing unit, which is movably supported by the guide shaft in the axis direction of the guide shaft and is capable of being fixed on the guide shaft; and a connecting unit configured to connect the first belt unit to the fixing unit with a clearance in the axis direction of the guide shaft;

wherein the fixing unit includes:

a cylinder member having an elastic part into which the guide shaft is inserted, wherein the cylinder member is arranged on a member that is a different member from the first belt unit to regulate the movement of the first belt unit around the axis of the guide shaft; and an operating member, which is arranged on a member that is a different member from the first belt unit, into which the cylinder member is inserted, and which is able to move around the axis of the guide shaft at between a fixed position where the elastic part is pressed to forcibly contact the guide shaft so as to fix the fixing unit on the guide shaft and a release position where the fixing of the fixing unit on the guide shaft is released by releasing the pressed connection between the fixing unit and the guide shaft;

the cylinder member includes:

a cylinder unit, having one end of which is provided with the elastic part and inserted with the guide shaft; and a third clamping part arranged at the other end of the cylinder unit; and the first belt unit includes:

a fourth clamping part, clamping with the third clamping part to regulate the rotation of the cylinder member around the axis of the guide shaft, which is able to move relatively with respect to the third clamping part in the axis direction of a third guide shaft;

a positioning unit configured to position the second belt unit in the axis direction of the guide shaft and connect with a clearance the second belt unit to the guide shaft around the axis of the guide shaft; and a first restriction unit configured to regulate the rotation of the first and the second belt units around the axis of the guide shaft; wherein the guide shaft is rotatable around the axis of the guide shaft; and the third clamping part and the fourth clamping part connect with a clearance the cylinder unit to the first belt unit around the axis of the guide shaft.

7. The printer according to claim 6, wherein the connecting unit includes:

a first clamping part arranged on either of the operating member and the first belt unit; and a second clamping part arranged on the other one of the operating member and the first belt unit and clamped with the first clamping part to increase a movable distance of the first belt unit with respect to the fixing unit in the axis direction of the guide shaft when the operating member is located at the fixed position compared with a movable distance of the first belt unit with respect to the fixing unit in the axis direction of the guide shaft when the operating member is located at the release position.

* * * * *